US011780646B2

(12) United States Patent
Rapparini et al.

(10) Patent No.: US 11,780,646 B2
(45) Date of Patent: Oct. 10, 2023

(54) PRODUCTION OF AIRTIGHT PACKAGES WITH SIDE GUSSETS

(71) Applicant: ICA S.P.A., Bologna (IT)

(72) Inventors: Gino Rapparini, Bologna (IT); Pietro Crescimbeni, Bologna (IT)

(73) Assignee: ICA SpA, Bologna (IT)

( * ) Notice: Subject to any disclaimer, the term of this patent is extended or adjusted under 35 U.S.C. 154(b) by 337 days.

(21) Appl. No.: 17/053,094

(22) PCT Filed: May 7, 2019

(86) PCT No.: PCT/IB2019/053738
§ 371 (c)(1),
(2) Date: Nov. 5, 2020

(87) PCT Pub. No.: WO2019/215615
PCT Pub. Date: Nov. 14, 2019

(65) Prior Publication Data

US 2021/0070503 A1 Mar. 11, 2021

(30) Foreign Application Priority Data

May 7, 2018 (IT) ..... 102018000005107

(51) Int. Cl.
*B65D 30/20* (2006.01)
*B31B 70/26* (2017.01)
(Continued)

(52) U.S. Cl.
CPC ..... *B65D 31/10* (2013.01); *B31B 70/16* (2017.08); *B31B 70/266* (2017.08); *B31B 70/36* (2017.08);
(Continued)

(58) Field of Classification Search
CPC ..... B31B 70/645; B31B 70/642; B31B 70/36; B31B 70/266; B31B 70/16;
(Continued)

(56) References Cited

U.S. PATENT DOCUMENTS 3,554,822 A 1/1971 Schwarzkopf
2001/0053253 A1 12/2001 Buchman et al. ..... 383/5
(Continued)

FOREIGN PATENT DOCUMENTS

DE 1629218 12/2001
EP 3 121 129 1/2017
(Continued)

OTHER PUBLICATIONS

International Search Report dated Aug. 19, 2019 in corresponding PCT application No. PCT/IB2019/053738, 3 pages.

*Primary Examiner* — Andrew M Tecco
*Assistant Examiner* — Jacob A Smith
(74) *Attorney, Agent, or Firm* — Fattibene and Fattibene, LLC; Paul A. Fattibene

(57) ABSTRACT

The present invention relates to a method for making airtight packages (100) made of flexible material that are configured to seal an environment inside the package with respect to an external environment, said packages (100) comprising a front panel (1), a back panel (2) and two side gussets (3, 4) provided at opposite ends of the front panel (1) and of the back panel (2) so as to connect the front panel (1) to the back panel (2). The method comprises a first step of folding a sheet (60) made of flexible material along two first fold lines (L1) which are mutually parallel so as to form a tubular element (61). Moreover, the method comprises a second step that consists in folding an end portion of the tubular element (61) along two second fold lines (L2) that are oblique with respect to the direction of the first fold lines (L1) so as to
(Continued)

form an end portion of the tubular element (61) that has two triangular portions (6, 7) having two mutually parallel sides (8, 9) and having a distance between each other equal to twice a first predetermined distance (D1). In addition, the present invention also comprises a machine (200) which allows using such method and a package that can be made by means of such method and such machine.

7 Claims, 16 Drawing Sheets

(51) Int. Cl.

| | |
|---|---|
| ***B31B 70/16*** | (2017.01) |
| ***B31B 70/64*** | (2017.01) |
| ***B31B 70/36*** | (2017.01) |
| *B31B 155/00* | (2017.01) |
| *B31B 160/20* | (2017.01) |

(52) U.S. Cl.
CPC ..... *B31B 70/642* (2017.08); *B31B 70/645* (2017.08); *B31B 2155/002* (2017.08); *B31B 2155/0014* (2017.08); *B31B 2160/20* (2017.08)

(58) Field of Classification Search
CPC ..... B31B 2155/002; B31B 2160/20; B31B 2155/0014
USPC ..... 493/210
See application file for complete search history.

(56) References Cited

U.S. PATENT DOCUMENTS

| | | | | |
|---|---|---|---|---|
| 2004/0258332 | A1* | 12/2004 | Totani | B65D 31/10 383/120 |
| 2016/0229146 | A1 | 8/2016 | Patel et al. | B31B 37/00 |
| 2017/0021584 | A1* | 1/2017 | Totani | B31B 50/81 |
| 2018/0370173 | A1* | 12/2018 | Garriga Jimenez | B31B 70/00 |

FOREIGN PATENT DOCUMENTS

| | | |
|---|---|---|
| JP | H1128771 | 2/1999 |
| JP | 2003300263 | 10/2003 |
| JP | 2004010055 | 1/2004 |
| JP | 2005112385 | 4/2005 |
| JP | 2010208332 | 9/2010 |
| WO | WO 2015040631 | 3/2015 |
| WO | WO 2017/017298 | 2/2017 |

* cited by examiner

PRODUCTION OF AIRTIGHT PACKAGES WITH SIDE GUSSETS

TECHNICAL FIELD

The present invention relates to the field of sealable packages. More specifically, the present invention relates to the field of sealable packages made of flexible material having side gussets, which preferably further have reclosable openings. Moreover, the present invention relates to the field of machines for making sealable packages and a method for making such packages.

STATE OF THE ART

Packages made of flexible material are commonly used in various fields: from the food to the industrial field. Packages made of flexible material for example, are commonly used to contain flour, grated cheese or the like, or alternatively for storing animal food, such as kibble for dogs or for cats.

Such packages have various sizes according to the use made of such packages. In the case of pet food for example, such packages have also very large sizes to allow storing an increased quantity of food.

For this purpose, to allow an increase of material stored in the packages, front area of the package being equal, such packages are provided with side gussets which allow the package to extend in depth so as to allow a significant increase of the inner volume.

Such side gussets normally are an accordion structure, which most times is a simple sheet made of flexible material folded in half and placed at opposite ends of the front panel and of the back panel of the package so as to connect the front panel to the back panel.

Due to the fact that such packages also contain food products, at times there is a need to provide such packages with reclosable openings that allow a user of the package to extract a given quantity of food product and to reclose the package after such quantity of product has been extracted from the package.

This ensures the possibility of storing the product contained in the package also after the package has been opened for the first time.

A substantial problem that arises most often is that the presence of the reclosable opening in some manner is an obstacle to the presence of the side gussets.

Indeed, in order to extract a predetermined quantity of food product contained in the package, it would be advantageous for such gussets not to be at the reclosable opening which normally is positioned on a front panel of the package, so that the user may easily extract the product from inside the package.

In this regard, the presence of the gussets hinders the extraction of the product contained in the package because part of the product in some manner remains "hidden" at the gusset opposite to the position wherein the reclosable opening is placed.

It would therefore be preferable to have a package that is free from gussets at the reclosable opening so as to allow an easier extraction of the product contained in the package.

As mentioned, such packages most often are sealable so as to prevent the possibility of the air outside the package from being introduced into the package and in some manner altering the properties of the materials contained in the package.

It therefore is the object of the present invention to make sealable packages made of flexible material that allow overcoming the above-mentioned problems. In particular, it is the object of the present invention to make a sealable package made of flexible material that has side gussets but that simultaneously allows an easier extraction of the material contained therein.

SUMMARY

The present invention is based on the idea of making a sealable package made of flexible material with side gussets wherein such side gussets have an upper oblique end portion having a substantially triangular shape, wherein the side of the triangle parallel to the outer edge of the package is positioned at a first predetermined distance from the outer edge of the package so that the side parallel to the outer edge of the package is spaced apart from the outer edge of the package.

According to an embodiment of the present invention, an (airtight) sealable package made of flexible material is provided, which is configured to seal an environment inside the package with respect to an external environment, said package comprising: a front panel configured so as to form a front face of the package, a back panel configured so as to form a back face of the package, two side gussets provided at opposite outer edges of the front panel and the back panel so as to connect the front panel to the back panel; wherein each of the side gussets comprises a portion of sheet made of flexible material folded along a first fold line parallel to the axis of the package so as to form the side gusset; wherein an end portion of each gusset positioned towards an upper edge of the package is folded along a second fold line that is oblique with respect to the axis of the package so as to form a triangular portion, wherein the triangular portion has a side parallel to the outer edge of the package and positioned close to the outer edge of the package; wherein the side parallel to the outer edge of the package is positioned at a first predetermined distance from the outer edge of the package so that the side parallel to the outer edge of the package is spaced apart from the outer edge of the package. This solution is particularly advantageous because it allows having an upper portion of the package free from gussets. Firstly, this implies that the activities of extracting the material contained in the package are particularly simplified. This is due to the fact that the presence of the gussets would instead make the extraction of the material more difficult. Moreover, it allows arranging a reclosable opening in a position wherein there are only two layers of material allows reducing the thickness of the package itself. This is because, since the reclosable opening in itself has a given thickness, arranging it in an area wherein there are only two layers (the front panel and the back panel) allows decreasing the thickness of the package itself (prior to being filled) with respect to a case wherein the reclosable opening is positioned in an area having four layers. This results for example, in a substantial simplification of the boxing process of the packages to be sold. In addition, the presence of the first predetermined distance allows effectively sealing the package and making it stronger. Triangular portion means a portion having two catheti and a hypotenuse that define such triangular shape of the triangular portion. Therefore, by indicating that one side of the triangular portion is at a predetermined distance with respect to the edge of the package, it means that any one of such hypotenuse and two catheti is at a predetermined distance with respect to the edge of the package.

According to a further embodiment of the present invention, a sealable package is provided, wherein the first predetermined distance is greater than or equal to 1 mm, more preferably greater than or equal to 2 mm, even more preferably greater than or equal to 3 mm, even more preferably greater than or equal to 4 mm. This contrivance is advantageous because it allows having a sufficient margin for effectively closing the package laterally. Such distance for the most part depends on the width of the side welding that allows the lateral closing of the package. Therefore, the greater such width, the greater the first predetermined distance.

According to a further embodiment of the present invention, a sealable package is provided, further comprising two side welding surfaces positioned at opposite ends of the front panel and the back panel, at side gussets, through which the side gussets are secured to the front panel and the back panel; wherein the side welding surfaces have a greater width than the first predetermined distance and a height preferably equal to the height of the package. This solution is advantageous because it allows securing the triangular portions to the outer seal of the packages so as to effectively close the package.

According to a further embodiment of the present invention, a sealable package is provided, further comprising a reclosable opening positioned close to the upper edge of the package, wherein the reclosable opening extends between the side welding surfaces. As described above, such solution is particularly advantageous because it allows installing a reclosable opening that allows reclosing the package also after it was opened the first time. The advantage is ensured by the fact that the reclosable opening is positioned in an area free from gussets and therefore having a relatively small thickness that is given by the thicknesses of the front and back panels of the package. Moreover, such reclosable opening preferably is on one of the front panel and the back panel of the package. Such reclosable opening preferably is a reclosable zipper that comprises two portions: a first portion positioned on the inner side of the front panel and a second portion positioned on the inner side of the back panel. Wherein the first portion is configured so as to be coupled to the second portion so as to allow a closure between the environment positioned above the zipper and the environment positioned below the zipper.

According to a further embodiment of the present invention, a sealable package is provided, wherein the triangular portion of each gusset has a side perpendicular to the outer edge of the package, the side being sealed to the outer edge of the package at the parallel side of the triangular portion. This solution is particularly advantageous because it allows securing an outer edge of the triangular portion to the outer edge of the package, therefore having an inner shape of the package adapted to keep such shape of the gusset, thus being a particularly solid package.

According to a further embodiment of the present invention, a sealable package is provided, wherein the side gussets are positioned at a lower edge of the package at a second predetermined distance from the lower edge of the package, wherein the second predetermined distance preferably is comprised between 1 mm and 5 mm, more preferably is equal to 3 mm. Such solution is particularly advantageous because it allows securing the gusset in the lower portion, "embedding it" in the lower seal of the package and therefore allowing to have a particularly stable bottom of the package.

According to a further embodiment of the present invention, a sealable package is provided, wherein an upper end of the gussets is at a third predetermined distance from the upper edge of the package so that an upper portion of the package is free from gussets, wherein the third predetermined distance preferably is greater than or equal to 40 mm, even more preferably greater than or equal to 50 mm. This solution is advantageous because as described above, it allows having an upper portion of the package free from gussets. These measures allow installing a reclosable opening in an effective manner. In this manner, such upper portion may preferably be used for positioning a reclosable opening so as to position such reclosable opening in an area wherein there are only two layers, that is the front panel and the back panel.

According to a particular embodiment of the present invention, a method is provided for making (airtight) sealable packages made of flexible material that are configured to seal an environment in the package with respect to an external environment, the packages comprising a front panel, a back panel and two side gussets provided at opposite ends of the front panel and of the back panel so as to connect the front panel to the back panel, wherein the method comprises the following steps:

a. folding a sheet made of flexible material along two first fold lines which are mutually parallel so as to form a tubular element;
b. folding an end portion of the tubular element along two second fold lines that are oblique with respect to the direction of the first fold lines so as to form an end portion of the tubular element that has two triangular portions having two mutually parallel sides and having a distance between each other equal to twice a first predetermined distance so as to be spaced apart from each other.

This solution is particularly advantageous because it allows having an upper portion of the package free from gussets due to such a fold of the tubular element. Firstly, this implies that the activities of extracting the material contained in the package are particularly simplified. Moreover, it allows for example, having a reclosable opening at a position wherein there are only two layers of material. This allows reducing the thickness of the package itself. In addition, the presence of the first predetermined distance allows effectively sealing the package and making it stronger.

According to a further embodiment of the present invention, a method for making sealable packages is provided, wherein the first predetermined distance is greater than or equal to 1 mm, more preferably greater than or equal to 2 mm, even more preferably greater than or equal to 3 mm, even more preferably greater than or equal to 4 mm.

According to a further embodiment of the present invention, a method for making sealable packages is provided, wherein the method further comprises the following step:

c. securing the triangular portions to the tubular element, preferably by welding the triangular portions to the tubular element.

This solution is particularly advantageous because it allows successively moving the folded tubular element without running the risk of the folds being modified or even completely disappearing. Moreover, it is actually possible to move the tubular element to position it in a predetermined position due to this securing.

According to a further embodiment of the present invention, a method for making sealable packages is provided, wherein the method further comprises the following steps:

d. conveying the tubular element having the triangular portions so as to insert it between a front sheet that will form the front panel or the back panel of the package, and a back sheet that will form the back panel or the front panel of the package;

e. cutting the tubular element along a first cutting line perpendicular to the axis of the tubular element so as to separate a portion of the tubular element.

This solution is particularly advantageous because it allows conveying the tubular element after securing it. This means that the means described in the preceding step that allow the welding of the tubular element may be positioned in an external area with respect to the portion wherein the front and back sheets are positioned, thus significantly simplifying the process. This is because the area comprised between the front sheet and the back sheet is not to house the welding means, as instead occurs in certain examples of the prior art. Thus, the tubular element is cut after the end portion is folded and after the tubular element is inserted in the area comprised between the front sheet and the back sheet.

According to a further embodiment of the present invention, a method is provided for making sealable packages, wherein during step e), the first cutting line along which the tubular element is cut is positioned at a second predetermined distance with respect to an edge of the sheets at which the tubular element is inserted between the sheets, wherein the second predetermined distance preferably is comprised between 1 mm and 5 mm, more preferably is equal to 3 mm. Such solution is particularly advantageous because it allows having a final package wherein the gusset is secured in the lower portion, "embedding it" in the lower seal of the package and therefore allowing to have a particularly stable bottom of the package.

According to a further embodiment of the present invention, a method is provided for making sealable packages, wherein during step d), the tubular element is conveyed up to reaching a third predetermined distance with respect to an edge of the sheets opposite to an edge at which the tubular element is inserted between the sheets, wherein the third predetermined distance preferably is greater than or equal to 40 mm, more preferably greater than or equal to 50 mm. This solution is advantageous because as mentioned above, it allows having a package having an upper portion free from gussets and positioning a reclosable opening in an area where there are only two layers of material. The more extended in axial direction the package is, preferably the larger the axial extension of the package is.

According to a further embodiment of the present invention, a method for making sealable packages is provided, wherein the method further comprises the following step:

f. securing the tubular element portion to the front sheet and the back sheet by means of welding performed along a welding surface parallel to the axis of the tubular element portion and positioned at the axis of the tubular element portion; the welding surface having a greater width than twice the first predetermined distance, wherein the tubular element portion preferably is secured to the front sheet and the back sheet so that the lower edge of the tubular element portion is positioned at a second predetermined distance with respect to an edge of the sheets at which the tubular element is inserted between the sheets, so as to be spaced apart from the edge.

This solution is particularly advantageous because it allows preferably continuously making equal packages having equally sized side gussets due to the fact that the cut is made at the axis of the tubular element portion. The term continuous here means a process that allows making packages one after another, thus with a temporal distance between making one package and the next. The term "continuous" here therefore means that while one station performs a given process on a package, another station performs another process on another package, that is that each station preferably can work continuously. Moreover, according to such preferable embodiment, wherein the tubular element portion preferably is secured to the front sheet and the back sheet so that the lower edge of the tubular element portion is positioned at a second predetermined distance with respect to an edge of the sheets, it actually is possible to allow securing the lower edge of the side gussets to the bottom of the package by means of a single seal, thus avoiding to make holes in the package to block the bottom.

According to a further embodiment of the present invention, a method for making sealable packages is provided, wherein the method further comprises the step of securing the tubular element portion to the front sheet and the back sheet by means of a seal positioned at the axis of the tubular element portion. This solution is particularly advantageous because it allows making the true seal, which allows closing the package as described in step f) in a successive step, thus being able to separate the position wherein the sealer is positioned that allows the welding of the outer edges and the position wherein a first coupling occurs. Such first coupling preferably occurs by means of a welding surface that circumscribes the seal stretches that were made to secure the triangular portions to the tubular element itself.

According to a further embodiment of the present invention, a method for making sealable packages is provided, wherein the method further comprises the following step:

g. cutting the welding surface along a second cutting line parallel to the axis of the tubular element and placed at the axis of the tubular element, the second cutting line extending for a length equal to the height of the package so as to separate one package from the next, the second cutting line being equally distant from the mutually parallel sides of the triangular portions.

According to a particular embodiment of the present invention, a machine for making (airtight) sealable packages made of flexible material is provided, which are configured to seal an environment inside the package with respect to an external environment, the packages comprising a front panel and a back panel, two side gussets provided at opposite ends of the front panel and the back panel so as to connect the front panel to the back panel, the machine comprises a tubular element forming station configured so as to form a tubular element from a sheet, the tubular element forming station comprises folding means configured so as to fold an end portion of the tubular element along fold lines that are oblique with respect to the axis of the tubular element so that a portion of the tubular element has an end portion of the tubular element having two triangular portions having two mutually parallel sides and having a distance between each other equal to twice a first predetermined distance so as to be spaced apart from each other. This solution is particularly advantageous because it allows having an upper portion of the package free from gussets due to such a station that ensures such oblique folding of the tubular element. Firstly, this implies that the activities of extracting the material contained in the package are particularly simplified. Moreover, having allows positioning a reclosable opening in a position wherein there are only two layers of material. This allows reducing the thickness of the package itself. In addition, the presence of the first predetermined distance allows effectively sealing the package and making it stronger.

According to a particular embodiment of the present invention, a machine is provided wherein the tubular element forming station further comprises securing means configured so as to secure the triangular portions to the tubular element, preferably by means of welding. This solution is particularly advantageous because it allows making a first seal that then allows moving the tubular element to a successive position without the folds hereto made on the tubular element being lost. Thus, the coupling of the tubular element may occur at a different point and at a given distance from the area where the folds of the tubular element are made.

According to a particular embodiment of the present invention, a machine is provided wherein the tubular element forming station further comprises movement means preferably comprising rotating elements configured so as to allow the movement of the tubular element along a conveying direction parallel to the axis of the tubular element through the rotation of the rotating elements. This solution is particularly advantageous because the rotating elements allow translating the tubular element along two opposite sliding directions according to the direction of rotation of the rotating elements. Moreover, the rotating elements allow preventing a possible deformation of the actual tubular element due to the fact that the tubular element is between pairs of rollers.

According to a particular embodiment of the present invention, a machine is provided further comprising a coupling station positioned at a predetermined distance with respect to the tubular element forming station, wherein the coupling station is configured so as to receive the tubular element coming from the tubular element forming station and to insert it between a front sheet that will form the front panel or the back panel of the package, and a back sheet that will form the back panel or the front panel of the package. This solution is particularly advantageous because the predetermined distance between the two stations allows conveying the tubular element after securing it. This means that the means that allow the welding of the tubular element may be positioned in an external area with respect to the portion wherein the front and back sheets are positioned, thus significantly simplifying making the machine. This is because the area comprised between the front sheet and the back sheet is not to house the welding means, as instead occurs in certain examples of the prior art.

According to a particular embodiment of the present invention, a machine is provided wherein cutting means configured to separate a portion of the tubular element from the tubular element along a first cutting line having a direction that is perpendicular to the axis of the tubular element, are positioned between the tubular element forming station and the coupling station.

According to a particular embodiment of the present invention, a machine is provided wherein the first cutting line of the cutting means is positioned at a second predetermined distance with respect to an edge of the sheets at which the tubular element is inserted so as to allow the tubular element portion to be completely enclosed within a lower closing seal that is configured so as to close the package at the bottom, between the front sheet and the back one, wherein the second predetermined distance preferably is comprised between 1 and 5 mm, more preferably is equal to 3 mm. Such solution is particularly advantageous because it allows having a final package wherein the gusset is secured in the lower portion, "embedding it" in the lower seal of the package and therefore allowing to have a particularly solid bottom of the package.

According to a particular embodiment of the present invention, a machine is provided wherein the machine further comprises a preferably vertical preparing station configured so as to provide the sheets to the coupling station; the preparing station comprising: cutting means configured so as to cut a sheet coming from reel so as to provide the front sheet and the back sheet having equal sizes; first welding means having direction coinciding with the conveying direction of the sheets, configured so as to secure a reclosable element, preferably a zipper length, coming from reel, to the front sheet and to the back sheet; and second welding means having direction perpendicular to the conveying direction of the front and back sheets and configured so as to secure the front sheet the back sheet with the reclosable element comprised between the sheets. This solution is particularly advantageous because firstly it allows starting from a single sheet that is then cut to form the two sheets: the front sheet and the back one. Moreover, the fact that the sheet comes from reel allows performing such operation continuously. Secondly, the presence of the first welding means allows securing the reclosable element—that preferably is a zipper length coming from reel—to the package in continuous manner. Thirdly, the presence of the second welding means allows securing the front sheet to the back one, thus preventing a possible mutual movement of the sheets when the front sheet is moved away from the back sheet in a successive station of the machine so as to create an opening for the passage of the tubular element. Another advantage is the one of securing the reclosable opening on the edges of the package. It is apparent that the three elements listed in this embodiment and comprised in such preparing station may be taken individually because they are not directly correlated with one another.

According to a particular embodiment of the present invention, a machine is provided wherein the coupling station further comprises welding means configured so as to seal the tubular element portion to the front sheet and the back sheet, wherein the welding means preferably are configured so as to make seals on a welding surface of the package, the welding surface being parallel to the axis of the package and having a greater width than twice the first predetermined distance. This solution is particularly advantageous because it allows making the closing seals while "trapping" the triangular positions of the end portion of the tubular element.

BRIEF DESCRIPTION OF THE DRAWINGS

The present invention is described with reference to the accompanying drawings wherein the same reference numbers and/or marks indicate the same parts and/or similar parts and/or corresponding parts of the system.

FIG. 5A shows a detail of a second station of the machine described in FIG. 3, wherein there is formed a tubular element according to a particular embodiment of the present invention, while FIG. 5B shows a section view of the tubular element 61 taken along the cutting line A-A in FIG. 5A.

FIG. 6A shows a detail of the tubular element forming station, more specifically it shows the system for moving the tubular element and for forming the fold lines that are oblique with respect to the axis of the tubular element, while FIG. 6B shows a section view taken along the cutting line A-A shown in FIG. 6A.

DETAILED DESCRIPTION

Figure 1:
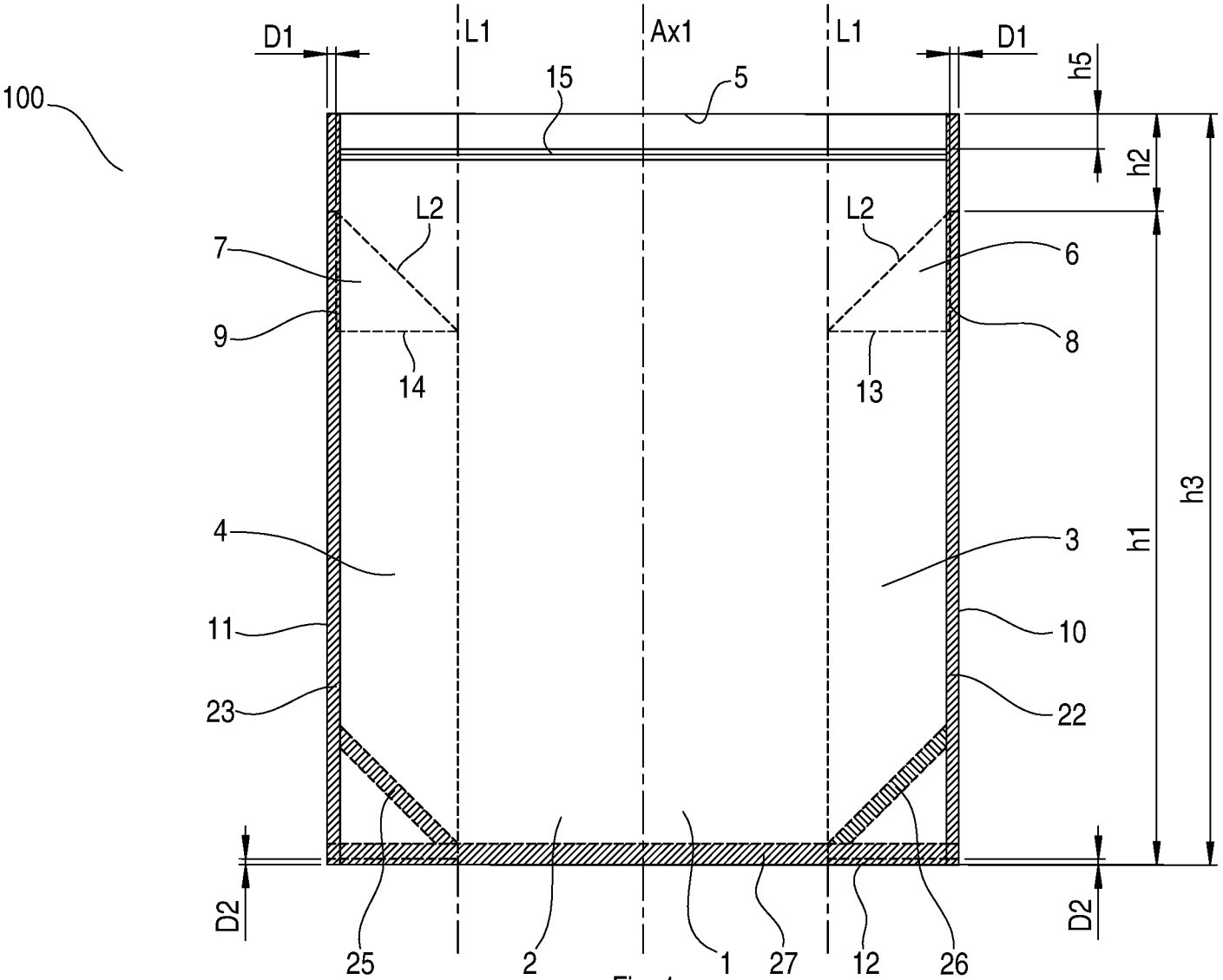
FIG. 1 shows a front view of a package made of flexible material according to an embodiment of the present invention.

The present invention is described hereinbelow by making reference to particular embodiments, as illustrated in the accompanying drawings. However, the present invention is not limited to the particular embodiments described in the following detailed description and depicted in the drawings, rather the embodiments described simply exemplify the various aspects of the present invention, the scope of which is defined by the appended claims. Further modifications and variations of the present invention will be apparent to those skilled in art.

Reference is made to the plane on which the sealable package 100 rests when reference in the present description is made to the terms "right", "left", "top", "bottom", "front" and "back". Therefore, the plane on which the sealable package 100 rests is a plane which is at the opposite side with respect to the one wherein the opening of the package is positioned. Therefore, the term "top" means a portion of the package placed at the opening of the package, through which the contents of the package may be inserted. Moreover, with respect to the plane on which the package 100 rests, right refers to the right side of the reader and similarly, left refers to the left side of the reader; finally, front is the portion of package facing the side of the reader and similarly, back refers to the opposite side with respect to the reader.

The terms "sealable" and "airtight" in the present invention mean a seal that is airtight to any gas. Indeed, the term air is used in a generic manner to indicate any type of gas known in the prior art.

The term conveying direction in the present invention means a direction along which the package 100, or parts thereof, is made. In this logic, if one process is performed "downstream" with respect to another, it means that during the process leading to making the package 100, such process is performed after another process was performed. In the same manner, if one process is performed "upstream" with respect to another, it means that during the process leading to making the package 100, a process is performed before another process was performed.

FIG. 1 diagrammatically illustrates a sealable package 100 according to an embodiment of the present invention.

FIG. 1 shows a front view of the package 100; in particular, the upper opening 5 of the package is positioned at an upper end of the drawing, while the lower edge 12 of the package 100 is positioned in the lower part of the drawing.

The package 100 is sealable because, as will be apparent from the following description, after filling the package 100 through the upper opening 5 and having made, at such opening 5, a welding surface adapted to close the opening of the package, it will be impossible for the atmosphere outside the package to enter the package. Therefore, the environment inside the package 100 will be completely isolated with respect to the external environment of the package 100.

The details of the package 100 described in FIG. 1 are now described, which will be apparent in the continuation of the description when the method for making the package is explained with reference to the following drawings.

The sealable package 100 made of flexible material comprises a front panel 1 and a back panel 2. The front panel 1 and the back panel 2 are connected by two side gussets: a right side gusset 3 and a left side gusset 4. Such side gussets 3, 4 are provided at opposite ends of the front panel 1 and of the back panel 2. The two side gussets 3, 4 comprise a sheet folded along a fold line L1 that is parallel to the axis Ax1 of the package. In this manner, an accordion structure is formed which allows increasing the distance between the front panel 1 and the back panel 2.

Clearly, it is also possible for the side gussets 3, 4, to comprise more than one fold line so as to significantly increase the distance between the two panels, and therefore significantly increase the volume of the package.

The front panel 1, the back panel 2 and the two side gussets 3, 4 preferably are made of sheets made of flexible and sealable material. Such sheets preferably are sealable only on one of the two surfaces.

For this reason, the front panel 1 and the back panel 2 have the sealable surfaces facing the inside of the package 100. In the same manner, the side gussets 3 and 4 have sealable surfaces facing the inside of the package 100. In particular, the side gussets 3, 4 have sealable surfaces facing the front panel 1 and the back panel 2 so as to allow a seal between the side gussets 3, 4 and the front and back panels 1, 2, so as to allow a side closure of the package 100 to be ensured.

As shown in the drawing, the package has a reclosable opening 15 positioned at an area close to the opening 5 of the package 100. Such reclosable opening 15 preferably extends along a direction perpendicular to the axis Ax1 of the package 100. Moreover as described later, the reclosable opening is comprised between the side welding surfaces 22, 23. An example of reclosable opening is given by a zipper which allows reversibly opening and closing such package 100. The reclosable opening 15 therefore extends between the front panel 1 and the back panel 2: a first portion of the reclosable opening 15 is installed on the inner surface of the front panel 1 of the package 100, while a second portion of the reclosable opening 15 is installed on the inner surface of the back panel 2 of the package 100. In this manner, the first portion can be engaged with the second portion so as to ensure the closure of the package 100 also after the package 100 has been opened for the first time.

An upper end portion of the side gussets 3 and 4 is folded along a fold line L2 which is inclined with respect to the axis Ax1 of the package 100. The portion folded along the fold line L2 therefore is an end portion of each side gusset 3, 4 which is in the vicinity of the opening 5 of the package 100.

The formation of triangular portions 6 and 7 of the side gussets 3 and 4 results from folding the end portion of the side gussets 3,4, and therefore the possibility of having an upper portion of the package 100 free from gussets. This allows positioning the reclosable opening 15 in the area where there are only two layers of material (area having two thicknesses): the layer of the front panel 1 and the layer of the back panel 2.

The triangular portions 6, 7 have the shape of a right-angled triangle having a hypotenuse that is inclined with respect to the axis Ax1 of the package and wherein the vertex of each triangular portion 6, 7, which is higher in the package 100, is positioned in a side area of the package at which the seal is made (which is further explained later), which allows joining the front panel 1 to the back one 2 with the side gussets 3, 4 comprised therebetween.

Each of the two triangular portions 6, 7 therefore has a cathetus 8, 9 parallel to the outer edge 10, 11 of the package and another cathetus 13, 14 perpendicular to the outer edge 10, 11 of the package 100.

As shown in the drawing, each cathetus 8, 9 parallel to the outer edge 10, 11 of the package is positioned at a predetermined distance D1 from the outer edge of the package. As will be more apparent later when the method for making the package 100 is explained, this allows welding the front panel 1 to the gussets 3, 4 and then to the back panel 2, therefore "trapping" each triangular portion 6, 7. This therefore allows ensuring an effective sealing of the environment inside the package with respect to the external environment.

Contrarily, if the cathetus 8, 9 were positioned so as to overlap the edge 10, 11 of the package 100, the risk would exist of not having a perfect seal of the package 100 with respect to the outside. Moreover, there would also be the problem of the formation of a kind of "side tab" placed at the upper portion of the gusset, which would in some manner risk breaking, therefore resulting in a particularly weak and fragile package.

As is shown in the drawing and as mentioned above, side seals 22, 23 are made at the right 10 and left 11 side edges of the package, said seals allowing to close the package 100 along the right side and the left side. Such seals 22, 23 extend along the whole height h3 of the package. The width of such seals is greater than the above-described predetermined distance D1.

In this manner, a portion of the cathetus 13 and 14 overlaps the side welding area 22 and 23, thus ensuring the securing of the triangular portion 6 and 7 to the edge by "trapping it".

As mentioned, the width of the welding surface 22 and 23 is greater than the first predetermined distance D1 so as to allow "trapping" the triangular portion between the front panel 1 and the back panel 2. In particular, such predetermined distance D1 may preferably be greater than or equal to 1 mm, and in certain cases, also have larger sizes. For larger packages for example, the distance D1 preferably is greater than or equal to 4 mm. It is apparent that such distance strongly depends on the sizes of the package. For example, smaller packages have a smaller distance D1. Vice versa, larger packages have a larger distance D1. In the same manner, the distance D1 depends on the width of the side welding surfaces 22 and 23. To this end, the wider such surfaces, the greater the distance D1.

In addition as shown in the drawing, a lower welding surface 27 adapted to close the bottom of the package 100 so as to prevent the material contained in the package to come out from the bottom, is positioned along the lower edge 12 of the package 100. Furthermore, there are two welding surfaces 25 and 26 that are inclined with respect both to the welding surface 22 and 23 and to the welding surface 27 to allow effectively emptying the package and at the same time strengthening the lower edges. The effective emptying is due to the fact that the welding surfaces 25 and 26 allow having a bottom of the package that is flat, and therefore easier to empty.

This contrivance allows the material contained in the package 100 to effectively exit, which otherwise could be trapped at the lower corners of the package 100. Indeed, it is the object of the welding surfaces 25 and 26 to also reduce the possibility of part of the contents of the package to remain trapped at the lower edges.

For example, in the case wherein the value of the material contained in the package is particularly high, for example in the case of food products, there would be a serious waste which in any case is to be reduced.

Moreover, the side gussets 3 and 4 are positioned at a predetermined distance D2 with respect to the lower edge 12 of the package 100. This is due to the fact that in this manner, the lower portion of the gussets may be "trapped" between the front panel 1 and the back panel 2. Such distance D2 may vary according to the size of the package 100. As an indicative value, such distance preferably is greater than or equal to 1 mm. Moreover, most of the time such distance preferably is less than 5 mm.

Packages like the ones shown in FIG. 1 may have a wide range of sizes. For example, they may have a size that varies from relatively small packages, configured so as to contain 0.1 kg of material, to much larger packages, that allow containing up to 20 kg of material.

Summarizing therefore, the right side gusset 3 and the left side gusset 4 extend along the side edge 10, 11, of the package up to a height h1 from the lower edge 12 of the package 100. Therefore as shown in the drawing, the height h3 of the package 100 is equal to the sum of the distance h2 of the upper end portion of the gussets 3, 4 up to the upper edge 5, with the distance h1. Such gussets 3, 4 are positioned at the predetermined distance D2 with respect to the lower edge 12 of the package 100 which therefore is represented by the lower edge of the front panel 1 and of the back panel 2. Moreover, the upper end portion of the right 3 and left 4 side gusset is positioned at a distance h2 of the opening 5 of the package 100. This allows having an inner portion of the package 100 free from gussets and therefore also an effective exit of the material contained in the package 100.

With reference to FIGS. 2 to 16, a machine 200 for making packages 100 like the ones in FIG. 1 and a method for making such packages 100, are described.

Figure 2:
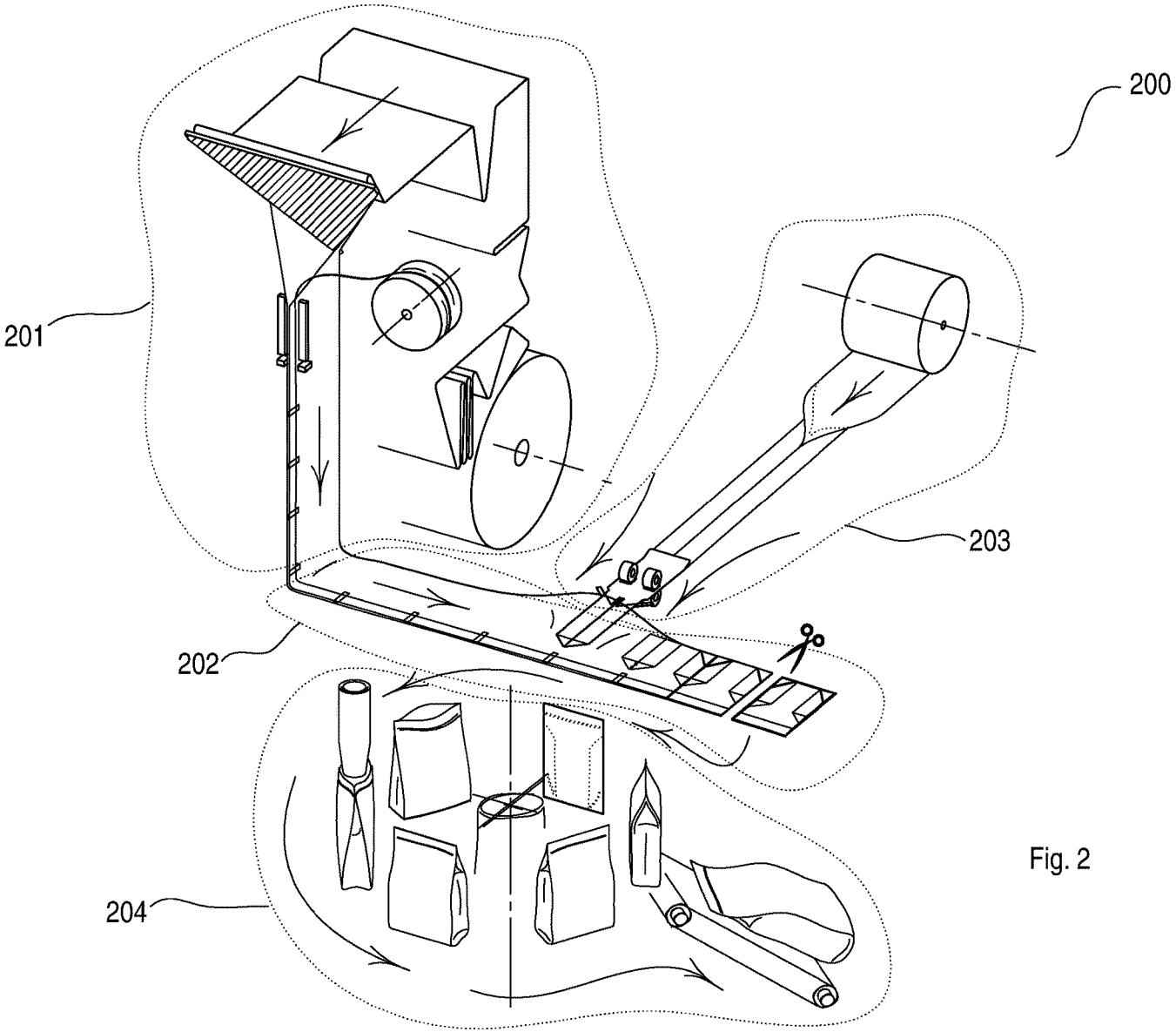
FIG. 2 shows a three-dimensional schematic view of a machine for making a package shown in FIG. 1, according to a particular embodiment of the present invention; wherein the dotted lines show ideal separation lines between the different stations of the machine.

FIG. 2 shows a machine 200 according to an embodiment of the present invention. The machine 200 shown in the drawing comprises four stations. A first station 201 is configured so as to prepare a strip of material which is then coupled in station 202 with the tubular element coming from the station 203. The station 203 is then configured so as to form the side gussets 2 and 3 of the package 100, which are shown in FIG. 1. Downstream of the coupling station 202, there is positioned a packaging station 204 wherein the package produced in the coupling station 202 is opened, filled with the contents of the package and finally closed at the opening 5 of the package 100 so as to seal the environment inside the package with respect to the external environment.

Indeed, the package 100 described in the present invention is a sealable package in the sense that the contents of the package are isolated with respect to the external environment when the upper opening of the package 5 is closed, therefore after the package 100 has been filled. Therefore, the external air cannot enter towards the interior of the package 100 and vice versa, the internal air cannot exit towards the exterior of the package.

Many packages that are completely different from the type of package described in the present invention are indeed know from the prior art. In particular, such packages have air channels positioned at side gussets. Such packages are used for example, to free gases contained in the package that are formed as time passes.

Figure 3:
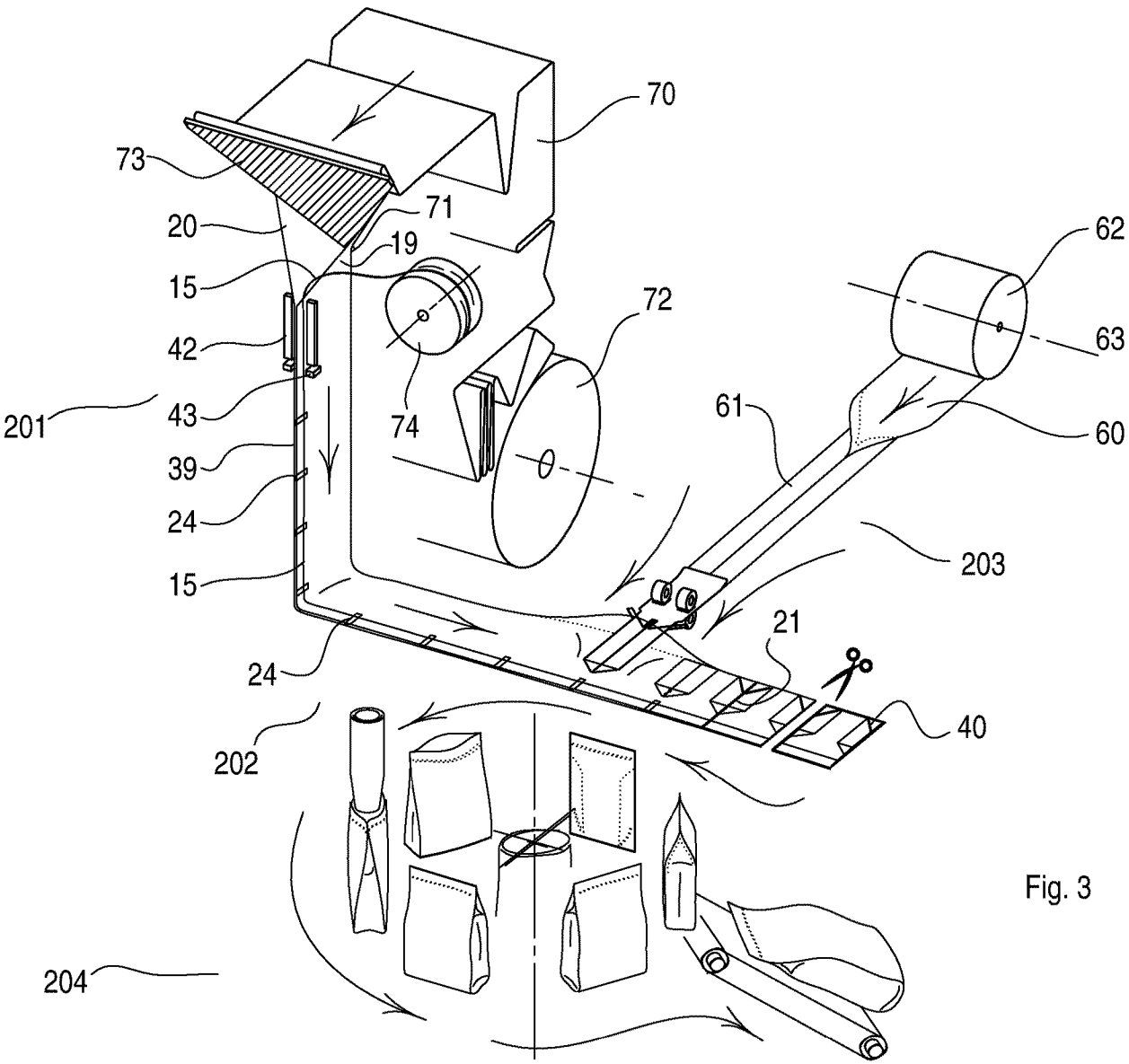
FIG. 3 more specifically shows the various components of the machine for producing packages depicted in FIG. 2, according to a particular embodiment of the present invention.

With reference now to FIG. 3, the preparing station 201, which is a vertical station in the particular example depicted in the drawing, the coupling station 202 and the tubular element forming station 203, are described in detail.

The method for making the package 100 will be apparent from the description of the various stations of the machine 200 and of how such stations contribute to making the package 100.

The preparing station 201 comprises a reel 72 on which a sheet 70 made of flexible material is wound, which as mentioned above, is sealable on one of the two sides.

The sheet 70 is unrolled from the reel 72 and conducted towards a forming device 73 which allows bending the sheet in half so as to form a folded sheet having a width equal to half the width that the sheet 70 had when it was positioned on the reel 72.

As mentioned, the sheet 70 is unrolled from the reel 72 and conveyed along the conveying direction indicated by the arrow in FIG. 3 towards the forming device 73, where it is folded. A blade 71 is positioned immediately downstream of the forming device 73, which blade allows cutting the sheet 70, therefore dividing it into two equal parts along the fold line that was provided by the forming device 73.

Therefore, downstream of the blade 71, there will be 71 two sheets 19, 20 placed on top of each other that can be conveyed downstream. The sheets 19, 20 have the sealable surfaces facing each other while the outer surfaces are not sealable, thus allowing the two sheets to be sealed to each other.

Alternatively, it is obviously also possible to replace the above-described system with two reels configured so as to provide the two sheets 19, 20 positioned on top of each other. For example, this alternative system could be preferred in the case it is preferred to have two sheets having different properties, such as for example, colour and thickness. However as is apparent, this latter system has the disadvantage of having two reels and therefore of requiring a greater volume.

A reel 74 is placed downstream of the blade 71, on which reel a zipper length 15 is wound, which may be used as reclosable opening of the package 100.

Thus, the zipper length 15 is unrolled from the reel 74 and coupled to both sheets 19, 20 produced downstream of the blade 71. For example, in the particular example depicted in the drawing, the zipper length 15 is coupled to the front sheet 19 and the back sheet 20 by means of welding bars 42 which allow welding the reclosable opening 15 to what will be the panels 1, 2 of the package 100.

As shown in the drawing, the reclosable zipper 15 is provided from reel 74 and is coupled both with the front sheet and with the back sheet by means of the seal provided by the welding bars 42. In particular, after the reclosable opening 15 is opened, that is after a first portion of the reclosable opening 15 is uncoupled from a second portion of the reclosable opening 15, the first portion of the reclosable opening 15 is constrained to the front sheet 19 and the second portion to the back sheet 20. Thus, it is effectively possible to reversibly open/seal the package 100 by means of a successive uncoupling/coupling of the first portion from/to the second portion.

Thus as mentioned, the reclosable zipper 15, which comprises such first and second portion, is conveyed into the portion comprised between the sheet 19 and the sheet 20 and is sealed thereto. Such portions preferably are then uncoupled from each other, after the welding has been performed by means of the welding bars 42.

Thus, a contrast element (not shown in the drawing) with the purpose of separating the first portion of the reclosable opening 15 from the second one preferably is positioned downstream of the welding bars 42.

In this manner, as seen in the continuation of the description, it is preferable to have the two portions of the zipper 15 uncoupled from each other in the final station where the various packages 100 are separated from one another so as to allow the package 100 to be filled without the need to first uncouple the two portion so as to provide the package with an opening for filling the same.

Welding grippers 43 are placed downstream of the welding bars 42, which as mentioned, are configured so as to longitudinally seal the zipper 15, the welding grippers allowing to make welding surfaces 24 along a direction perpendicular to the conveying direction of the sheets 19 and 20. In the case wherein there is the above-described contrast element, it is between the welding bars 42 and the welding grippers 43.

These welding surfaces 24, which are introduced in greater detail with reference to the following drawings, allow securing the front sheet 19 to the back sheet 20 with the reclosable opening 15 comprised between such sheets 19, 20. Moreover, it is possible to flatten the zipper 15 at such welding surfaces 24 in order to reduce the thickness thereof. This then allows facilitating the side seals of the package, which are described later.

Each welding surface 24 produced by the welding grippers 43 is positioned close to the edge of the sheets 19 and 20. The term "close to" here means that there may also be a given distance between the edge of the sheets 19 and 20 and such welding surface 24, which is due for example, to margins of error required when positioning the welding grippers 43. In any case, it is preferable for such welding surface to be positioned next to the edge of the sheets 19, 20.

The closing surface, which then is the upper edge of the package 100 at which the opening 5 of the package 100 is positioned, extends along a direction parallel to the edge of the sheets 19, 20, i.e. longitudinal to the conveying direction of the sheets 19, 20. It therefore is apparent that given that the distance (see distance M1 in FIG. 13) between two consecutive midpoints of welding surfaces 24 is measured along the conveying direction of the sheets 19, 20, it is equal to the width of the package 100 that is then formed.

The length h4 (shown in FIG. 10) of such welding surfaces 24 preferably is comprised between 35 mm and 50 mm. According to a particular embodiment, such extension preferably is equal to 40 mm. In any case, the above-mentioned extensions strongly depend on the height of the final package 100 and therefore on the width of the sheets 19, 20 which as described later, coincides with the longitudinal extension h3 of the package.

It is important for such welding surfaces 24 to have a length which as described later, allows introducing a tubular element that will form the side gussets 3, 4. Thus, the higher the height h4, the larger is the portion of the package that is free from gussets. Therefore, in the case wherein the length h4 is equal to 40 mm, the portion of package free from side gussets will have an axial extension equal to at least 40 mm, preferably equal to 50 mm. This is because the tubular element cannot move close to the edge of the sheets 19, 20 at which the opening 5 of the package 100 is positioned, as described later.

The sheets 19 and 20 are conveyed downstream of the welding grippers 43 in downstream direction by means of the aid of movement elements (not shown in the drawing), which for example, are simple rollers. The procedure used by the preparing station 201 is shown in greater detail with reference to FIG. 4.

Figure 4:
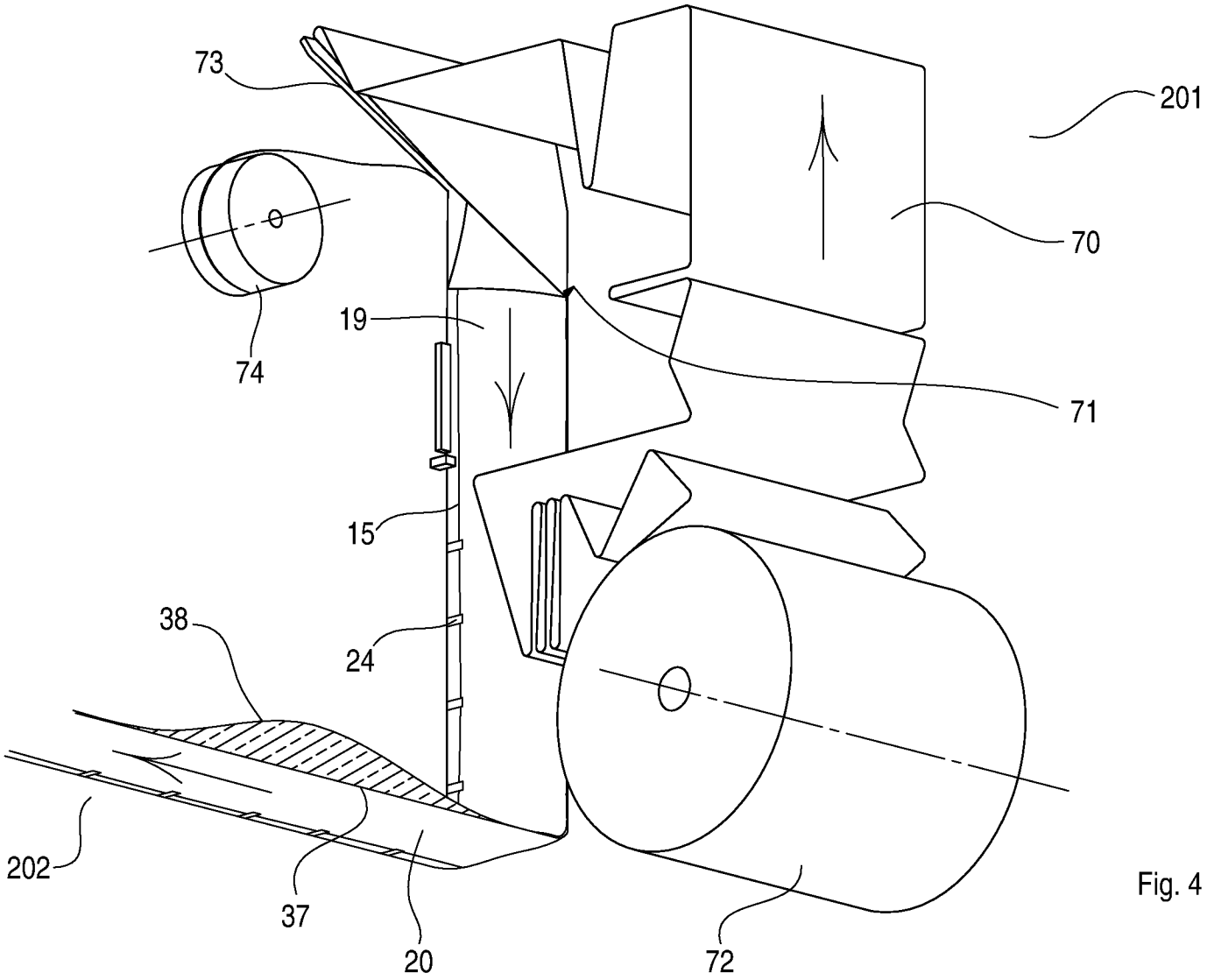
FIG. 4 shows a detail of a first station of the machine described in FIG. 3.

FIG. 4 clearly shows how at a given distance downstream of the portion where the welding surfaces 24 are made, the front sheet and the back sheet 19 and 20 are opened with respect to each other along an edge 37, 38 that is opposite to the edge along which the above-described welding surfaces 24 are made.

The edge 37 of the back sheet 20 and the edge 38 of the front sheet 19 therefore are positioned at the one which forms the lower edge 12 of the package 100.

Returning again to FIG. 3, the coupling station 202 is positioned downstream of such first preparing station 201, the coupling station being configured so as to couple the sheet 19 and the sheet 20 coming from the first station 201 with the tubular element 61 coming from the tubular element forming station 203, which is described later.

Therefore, the operating method of the tubular element forming station 203 that provides the tubular element to the coupling station 202 is described in detail before getting into the description of the coupling station 202.

As shown in FIG. 3, the conveying direction of the tubular element 61 is perpendicular to the conveying direction of the front sheet 19 and of the back sheet 20 described above.

Figures 5A, 5B:
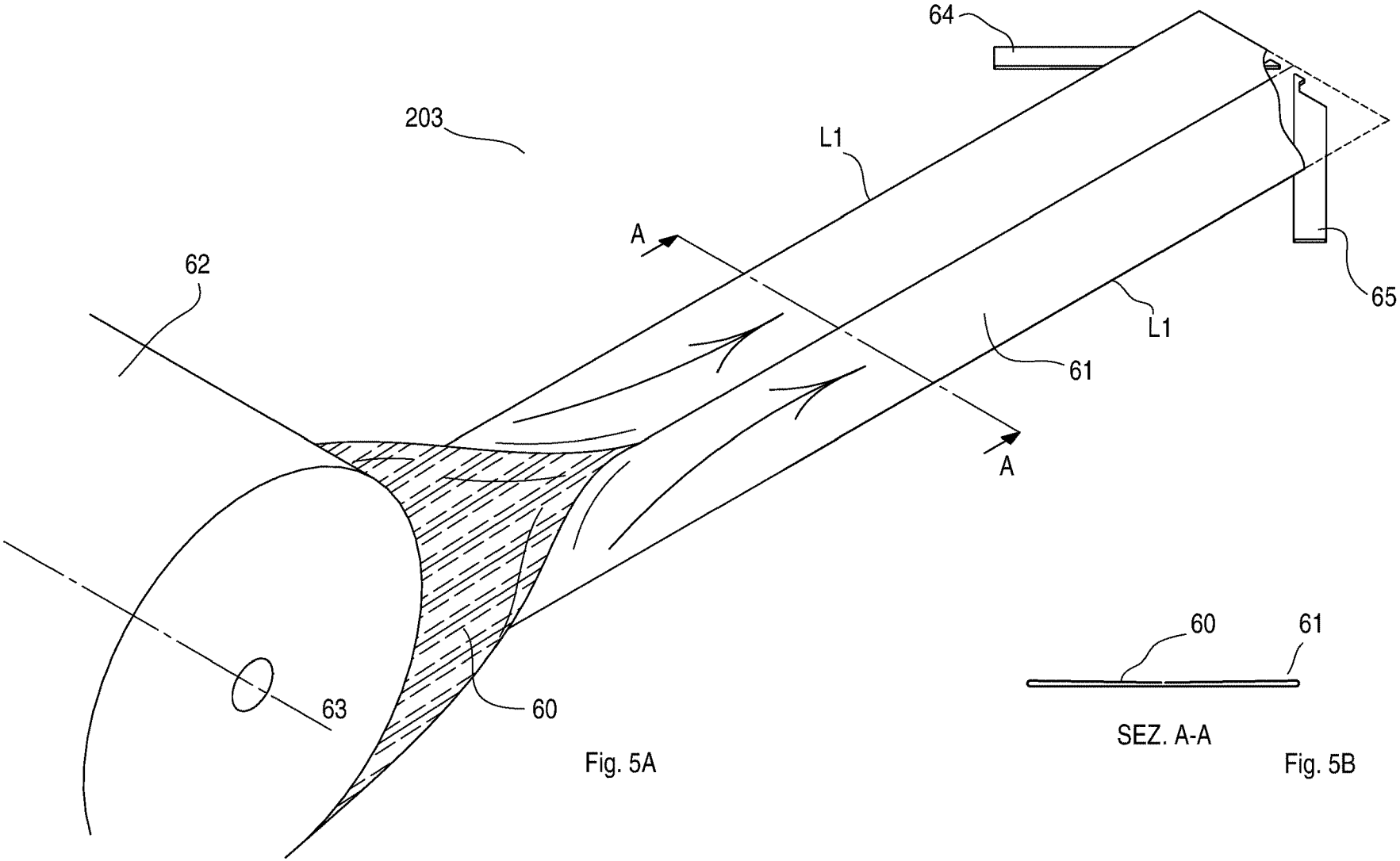

With reference to FIGS. 5A and 5B, the method with which such tubular element is made is described in detail. As shown in the drawing, a sheet 60 is rolled along a reel 62 configured to rotate about an axis 63. By rotating the reel 62, the sheet 60 is unrolled and the tubular element 61 is formed with the aid of a commonly known forming device (not shown in the drawing).

Tubular element means a sheet having a flattened tube structure that extends along a direction. The tubular element is formed from a sheet through two mutually parallel fold lines L1. As shown in the drawings, the two fold lines L1 allow moving the outer edges of the sheet 60 closet to each other so that the right edge of the sheet is positioned at the left edge of the sheet. The point wherein the right edge of the sheet meets with the left edge of the sheet coincides with the midpoint of the tubular element. The fold lines L1 indeed are arranged at the same distance with respect to the outer edges of the sheet 60.

An example of the structure having tubular element 61 is clearly shown in the section view A-A in FIG. 5B. Such drawing shows the fact that the tubular structure 61 has a lower edge that is continuous, while an upper edge has a slight discontinuity. The reason for the discontinuity lies in the fact that as described above, the upper edge of the tubular element 61 comprises the right edge of the sheet 60 and the left edge of the sheet 60 placed at each other. Therefore, there is a central portion of the upper edge of the tubular element 61 that represents a transition portion between the left edge and the right edge of the sheet 60.

In any case, the forming device that folds the sheet 60 along the fold lines L1 allows positioning the outer edges of the sheet 60 at each other so as to substantially make such discontinuity zero. It is worth noting that for illustrative purposes, such distance between the left and right edges is rather accentuated in FIG. 5B so as to allow the reader to understand that it is a tubular element and that the portion where there is such discontinuity is the portion where the right edge and the left edge of the sheet 60 meet. In reality, it is apparent that the area of discontinuity provided by the forming device is much less apparent.

Figures 6A, 6B:
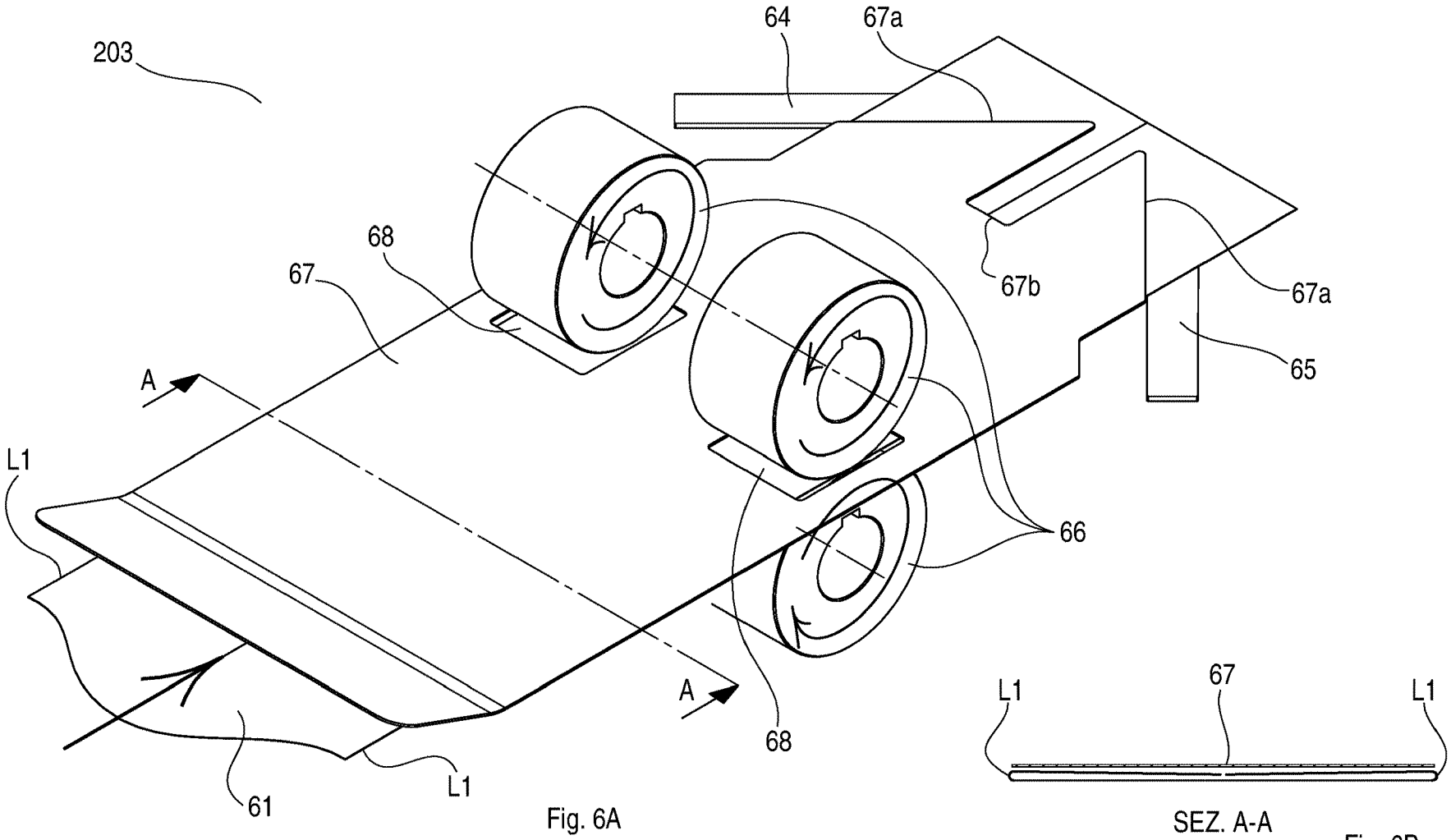

With reference to FIGS. 6A and 6B, they show the elements that allow the tubular element 61 to be folded and conveyed.

In particular, FIG. 6A shows that the conveying of the tubular element 61 along a direction perpendicular to the conveying direction of the sheets 19 and 20 shown in FIG. 3, is ensured by counter-rotating rollers 66 placed at two different levels.

The tubular element 61 is conveyed below a plate 67 on which there are provided two openings 68 which allow the counter-rotating rollers 66 to directly contact the tubular element and to convey it along a conveying direction by means of the rotation thereof. In the particular example shown in the drawing, given that the number of openings 68 is equal to two, the number of rollers is therefore equal to four.

However, it also is possible to increase or decrease the number of openings 68, and therefore of rollers 66, as desired according for example, to the sizes of the tubular element 61 or also for example, to the thickness or the rigidity of the material with which the tubular element 61 is made.

As mentioned above, like the sheet 70, the sheet 60 is a sheet made of flexible material having a welding surface and a non-welding surface. In the particular example shown in the drawing, the welding surface is the one external to the tubular element 61 that therefore forms the outer surface of the tubular element, while the non-welding surface is the inner one with respect to the tubular element 61.

As mentioned, each pair of rollers 66 positioned respectively above and below the plate 67 comprises two rollers 66, wherein one roller is configured so as to rotate in opposite direction with respect to the roller positioned above/below it.

Folding means 64 and 65 placed oblique to the conveying direction of the tubular element 61 shown in the drawing, are positioned at the end portion of the plate 67. The folding means 64 and 65 are positioned at the bottom with respect to the tubular element 61 so that the tubular element 61 may slide over them. As described below, it is possible to provide the end portion of the tubular element with an arrow structure by means of rotating the folding means 64 and 65 about the axis thereof.

Figure 7A:
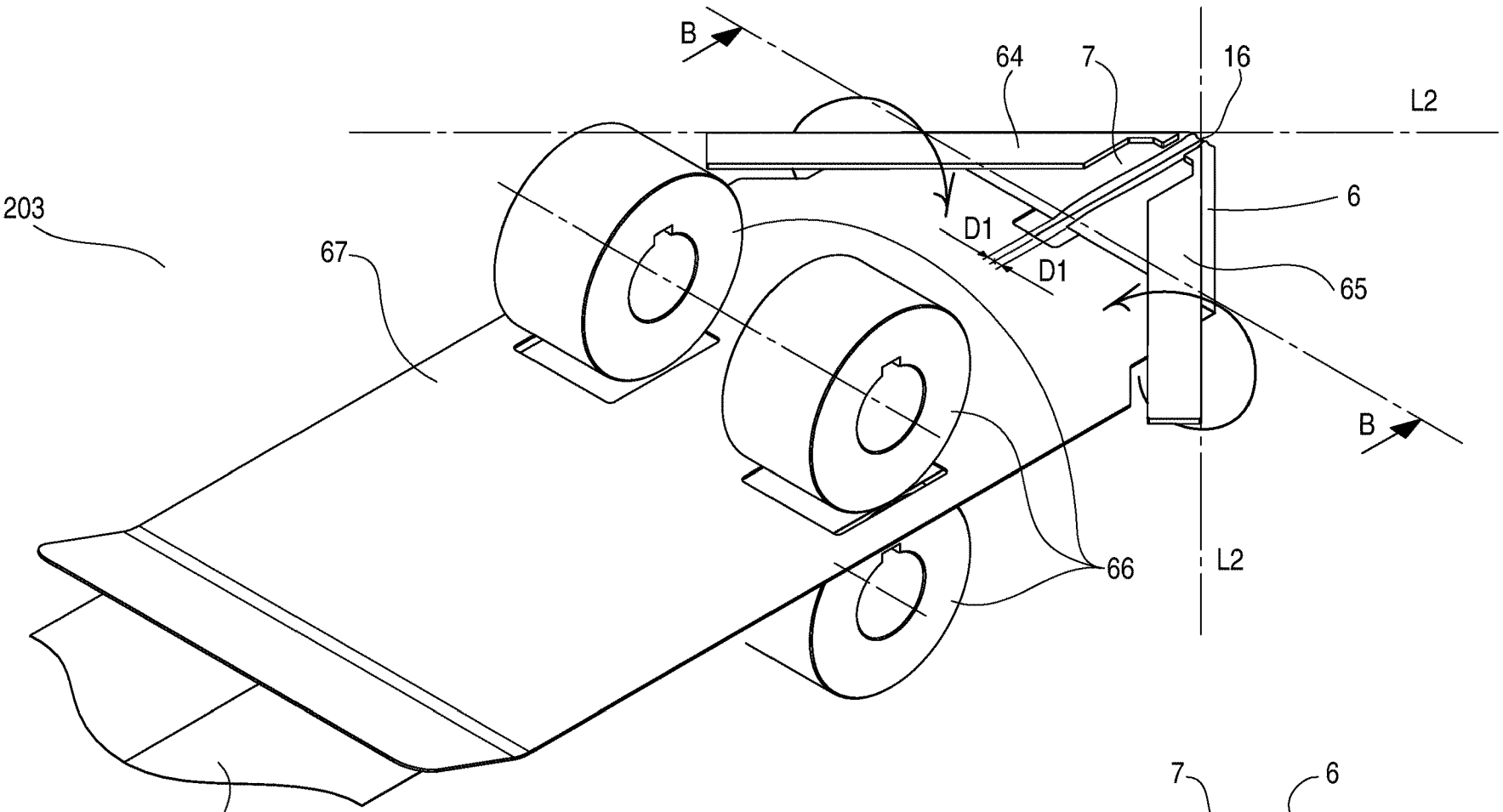
FIG. 7A shows the detail of the tubular element forming station shown in FIG. 6A, in a successive state, after an end portion of the tubular element was folded along fold lines that are inclined with respect to the axis of the tubular element.

Such folding means 64 and 65 are shown more clearly with reference to FIG. 7A. As shown, such means have a substantially rectangular shape. In particular, such folding means 64 and 65 have an inner edge having a form that deviates from the rectilinear one in the particular state shown in FIG. 7A (that is, after they have performed the rotation about the axis thereof, thus forming the arrow structure). Firstly, the central "pointed" end portion allows optimizing the folding process. Otherwise, the cavity positioned at the central end portion of the folding means 64 and 65 allows securing the fold by means of welding, as will be more apparent when the welding means 44 are described.

In particular, the fold of the end portion of the tubular element 61 is ensured by the joint operation carried out by the folding means 64 and 65 and by the inclined edges 67*a* of the end edge of the plate 67 that have a similar shape to the one of the folding means 64 and 65.

In particular, the end edge of the plate 67 has two portions 67*a* that are inclined with respect to the axis of the tubular element 61 and are symmetrical with respect thereto. Such inclined portions 67*a* substantially are arranged parallel to the folding means 64 and 65. In addition, the end edge of the plate 67 has a substantially rectangular opening 67*b* positioned at the axis of the tubular element 61.

Therefore, when the tubular element 61 that slides below the plate 67 arrives close to the end portion of the plate 67, it will be visible at the central rectangular portion 67*b* of the plate 67. This configuration is advantageous because it is possible to seal the triangular portions 6, 7 of the tubular element 61 to the tubular element 61 itself, at the rectangular opening 67*b*, after the fold was made by the folding means 64 and 65 with the aid of the inclined edges 67*a* of the plate 67. As described above, the access to the rectangular portion 67*b* is also ensured by the particular shape of the end portion of the folding means 64 and 65.

As shown in FIG. 7A, by rotating the folding means 64 and 65 about the axis thereof, they rotate an end portion of the tubular element 61 so as to form two triangular portions 6, 7 placed symmetrically opposite to the axis of the tubular element 61. After the fold is made, the two right-angled triangles 6 and 7 that were formed and that in essence are the folds of the tubular element 61, are at a predetermined distance that is equal to twice the distance D1 that was described with reference to FIG. 1.

In this manner, an end portion of the tubular element having a substantially trapezoidal shape, therefore an upper base 16 equal to twice the predetermined distance D1, is formed by means of the fold of the end portion of the tubular element 61.

Figure 7B:
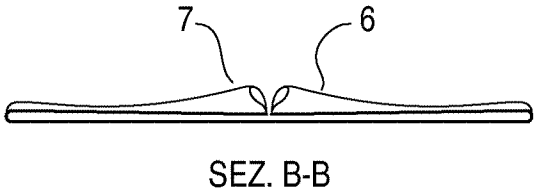
FIG. 7B instead shows a section view along the cutting line B-B shown in FIG. 7*a*, and in particular it shows a section view of the triangular portions 6 and 7.

FIG. 7B shows a section view along the cutting line B-B in FIG. 7A. As is shown in the section view, there are two triangular portions 6 and 7 that, after the fold is made, are not perfectly resting on the tubular element 61 itself due to the fact that the end portion of the plate 67 is comprised between the tubular element 61 and the triangular portions 6 and 7.

Figure 8:
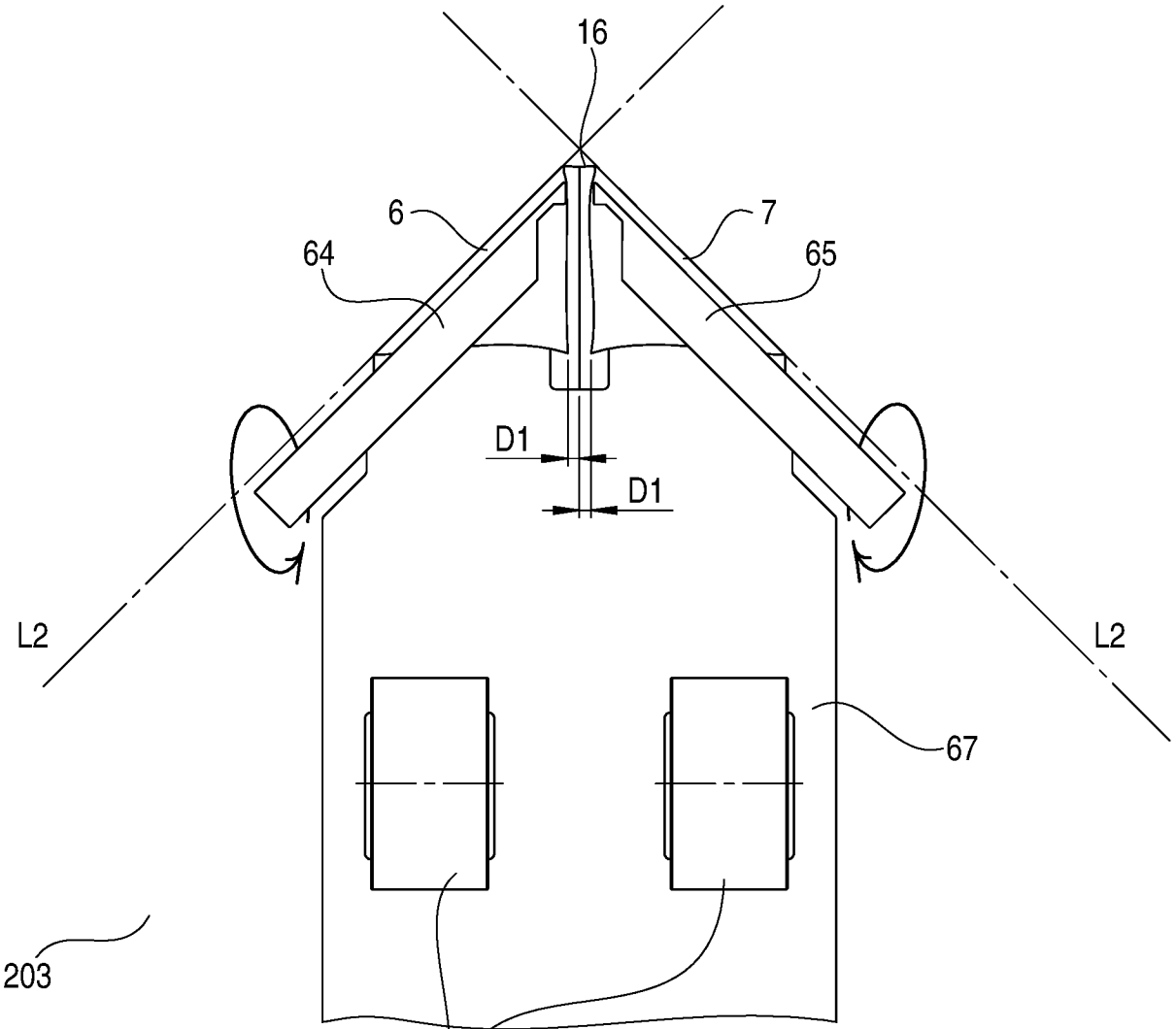
FIG. 8 shows a top view of the detail shown in FIG. 7A.

FIG. 8 clearly shows a top view of the state of the end portion of the tubular element 61 after the fold is made by means rotating the folding means 64 and 65 about the axis thereof, with the co-participation of the oblique end portion 67*a* of the plate 67 that allowed making the fold along the fold lines L2 that coincide with the inclination of the oblique end portion 67*a*.

Figure 9:
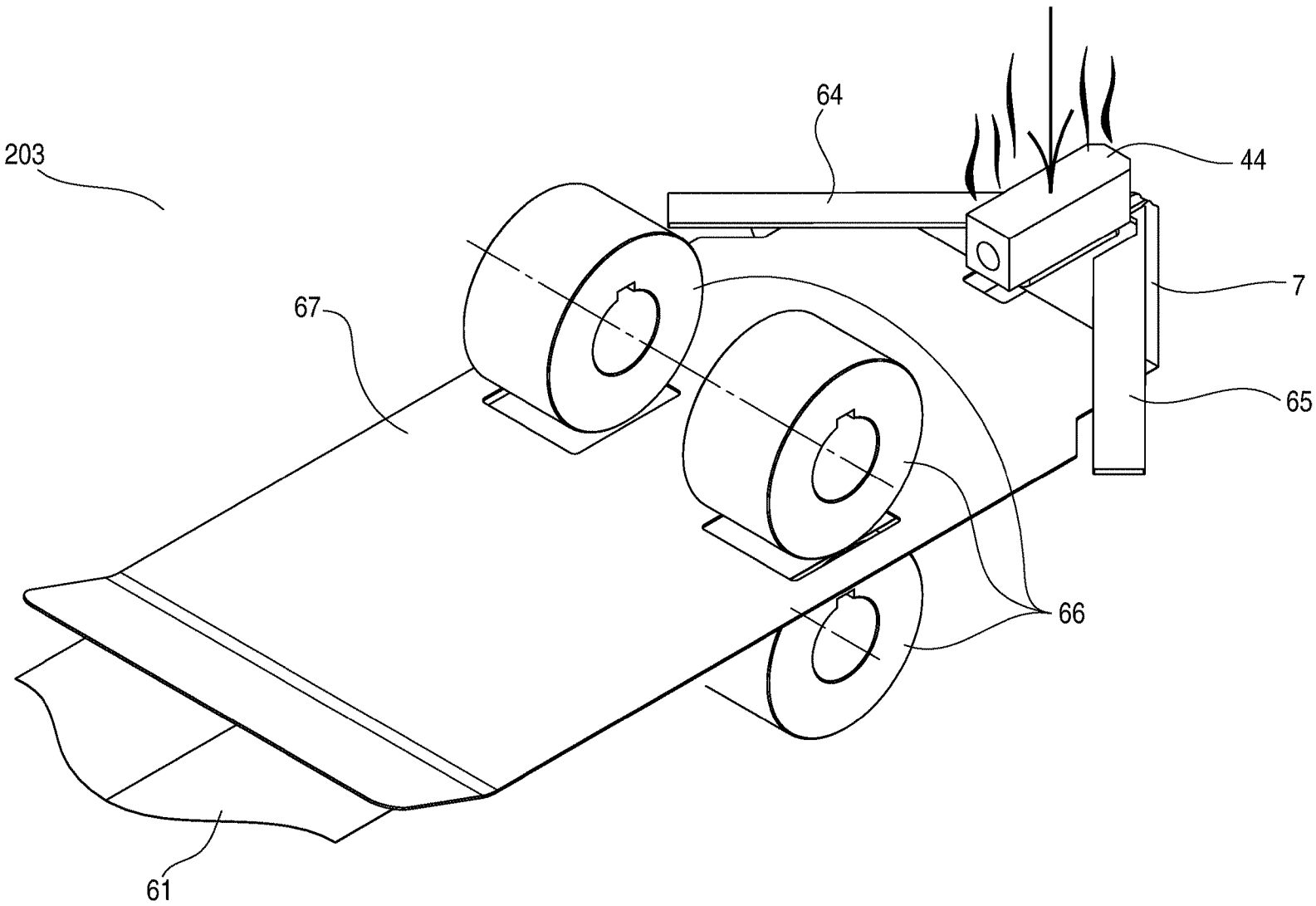
FIG. 9 shows a three-dimensional view of the detail shown in FIG. 7A, in a successive state after the triangular portions 6 and 7 were secured by means of welding the tubular element 61.

FIG. 9 shows a successive state with respect to the one shown in FIG. 8. A seal between the triangular portions 6 and 7 and the central portion of the tubular element 61 is made in this state due to the fact that the oblique portions 67*a* are placed at a given distance due to the rectangular opening 67*b*, as mentioned above. In this manner, it is possible to secure the triangular portions 6, 7 to the tubular element 61 itself so that the fold line L2 that was provided in the preceding step is kept following a successive movement of the tubular element 61.

Figure 10:
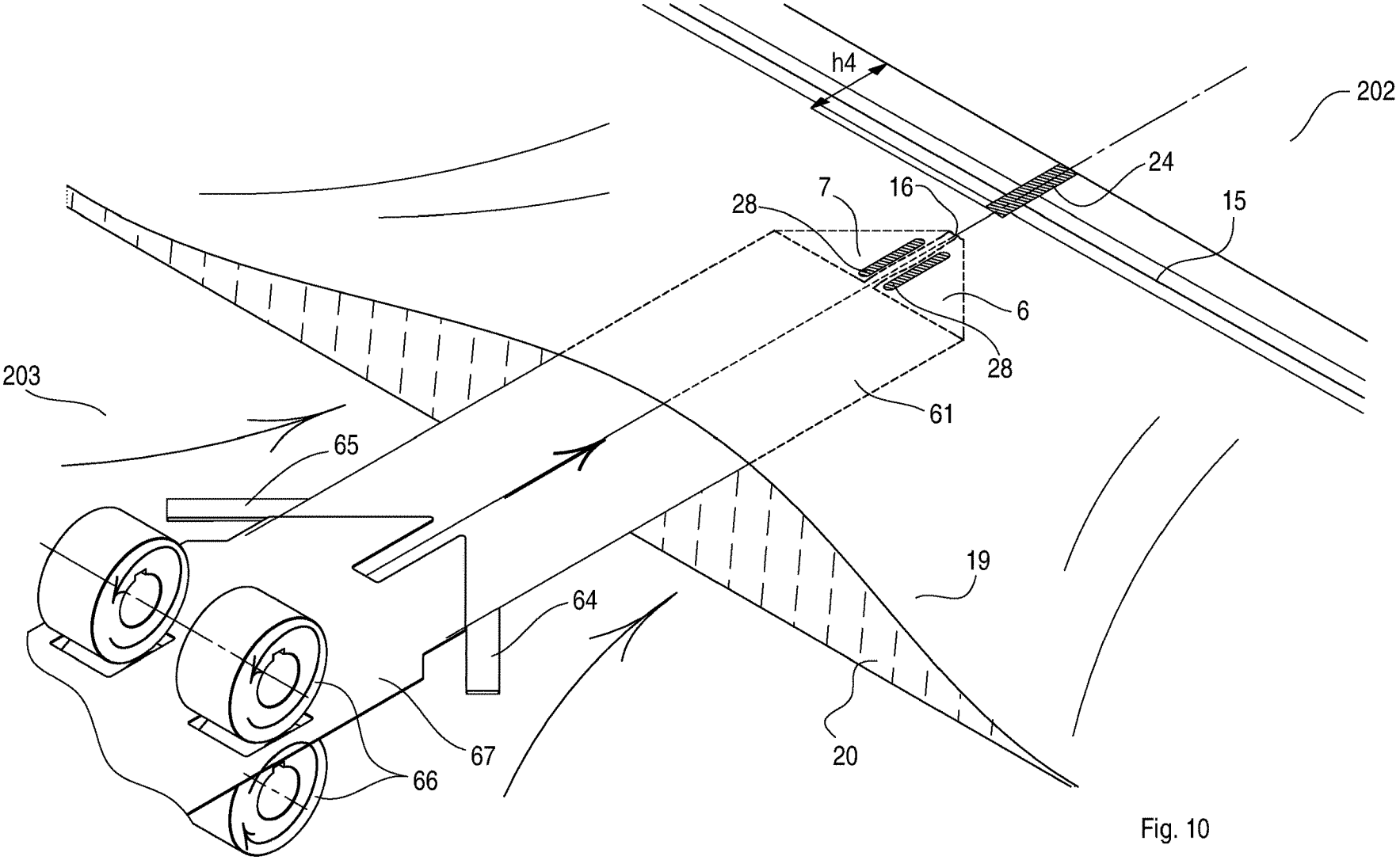
FIG. 10 shows a three-dimensional view of the tubular element forming station shown in FIG. 9, and of a coupling station wherein the tubular element is inserted between the sheets coming from the first station shown in FIG. 4.

In the particular example shown in the drawing, the welding means 44 allow welding the triangular portions 6 and 7 to the tubular element 61 by means of two seal stretches 28 that extend mutually parallel along the sides of the triangular portions 6, 7. In particular as shown in FIG. 10, each of the two seal stretches 28 seals respectively one of the triangular portions 6, 7 to the tubular element 61. However, it is apparent that the number of seal stretches 28 may vary, as the shape of such stretches may vary.

Alternatively, the triangular portions 6, 7 could also be "tacked" to the tubular element 61 by means of one or more circular seal spots positioned at the axis of the tubular element 61, wherein such seal spots preferably would allow simultaneously welding both triangular portions 6, 7 to the tubular element. Moreover, such shape of the tacking can also be other than circular, such as for example ellipsoid-shaped. However, it is apparent that such tack spots alternatively can also be made in side portions with respect to the axis of the tubular element 61.

Returning to FIG. 3, it was mentioned that the tubular element 61 is conducted into a portion comprised between the front sheet 19 and the back sheet 20 along a direction perpendicular to the conveying direction of the sheets 19 and 20. In addition, as shown in FIG. 10, the tubular element 61 is conveyed into the inner area between the sheet 19 and the sheet 20, at the welding surface 24 that was made before, so that the axis of the tubular element 61 coincides with the symmetry axis (perpendicular to the edges 19, 20) of the welding surface 24. This contrivance is important because in this manner, it is possible to make packages having a central symmetry axis.

As mentioned, the conveying of the tubular element 61 is ensured by the rotation means 66 that allow the insertion thereof into the portion comprised between the front sheet 19 and the back sheet 20. The tubular element 61 is inserted until the upper base 16 reaches a distance h2 with respect to the edge of the sheet 19, 20 that is opposite to the one 37, 38 at which the tubular element 61 was inserted.

The distance h2 preferably is in the range of tens of a millimetre, for example greater than or equal to 40 mm, more preferably greater than or equal to 50 mm. Such distance strongly depends on the sizes of the package 100. As described above with respect to the package 100, this distance h2 allows having the great advantage that an upper portion of the package 100 is free from gussets at which a reclosable opening 15 can be positioned.

After the tubular element 61 has reached such distance h2 from the opposite edge with respect to which it was inserted, the tubular element 61 is cut through cutting means 33 along the cutting line L3 placed at a distance D2 with respect to the lower edge of the package so as to separate a tubular element portion 69.

This distance D2 was already described above with reference to the package in FIG. 1 and as mentioned above, serves to allow effectively closing the side gussets 3, 4 within a lower welding surface 27. Therefore, the cutting means 33 are positioned between the front sheet 19 and the back sheet 20 to allow such cutting.

It is apparent that such cutting process of the tubular element 61, which allows separating the tubular element portion 69, may alternatively be performed before the tubular element itself is conveyed into the area comprised between the two sheets 19, 20. In this manner, there is no need to position the above-described cutting means 33 at the area comprised between the two sheets 19, 20. By way of example, such cutting means 33 can also be placed upstream of the area wherein the above-described fold of the end portion of the tubular element 61 is made. Here, the tubular element portion 69 is conveyed into the area comprised between the sheets 19 and 20 until the tubular element portion 69 reaches the distance h2 from the above-described edge and therefore, accordingly reaches the distance D2 from the edge at which such tubular element portion 69 is inserted.

Later, to allow securing the tubular element portion 69 cut beforehand to the front sheet 19 and the back sheet 20, a further welding surface 29 is made that allows welding the three components together. Such welding surface 29 can have various shapes.

Figure 11:
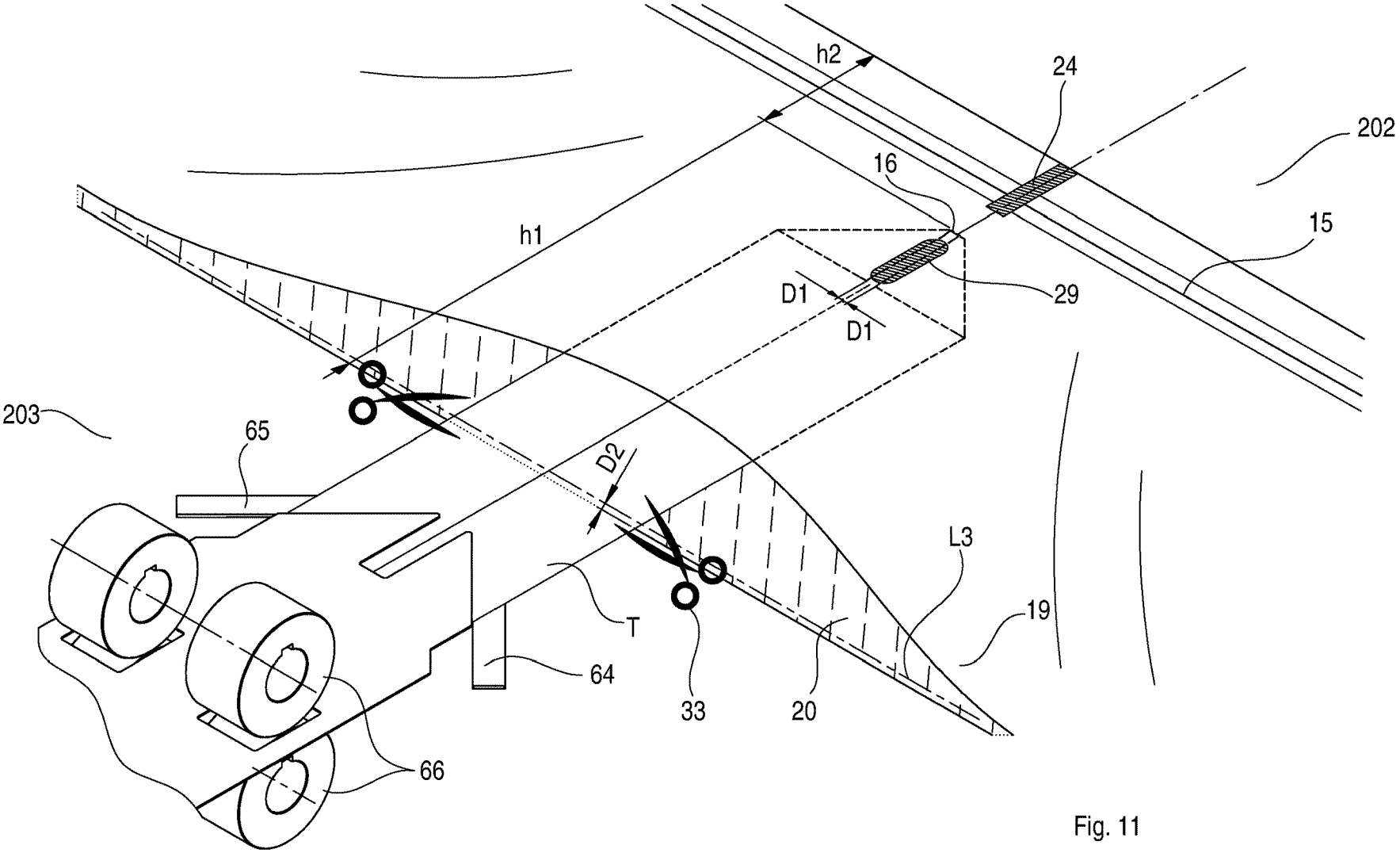
FIG. 11 shows a three-dimensional view of the stations depicted in FIG. 10, in a successive state, after the tubular element is cut along a cutting line.

In the particular example shown in FIG. 11, the seal is obtained by means of a welding surface 29 that circumscribes both the seal stretches 28 shown in FIG. 10. Here too, such welding could alternatively be obtained by means of one or more seal spots having for example, circular shape.

Moreover, further various shapes of welding surfaces may be obtained. For example, larger welding surfaces can also be applied, that interact with the welding surface 24 made beforehand. For example, there could be a welding surface that extends along the direction perpendicular to the edge of the sheets 19, 20 and that circumscribes the whole welding surface 24.

Figure 12:
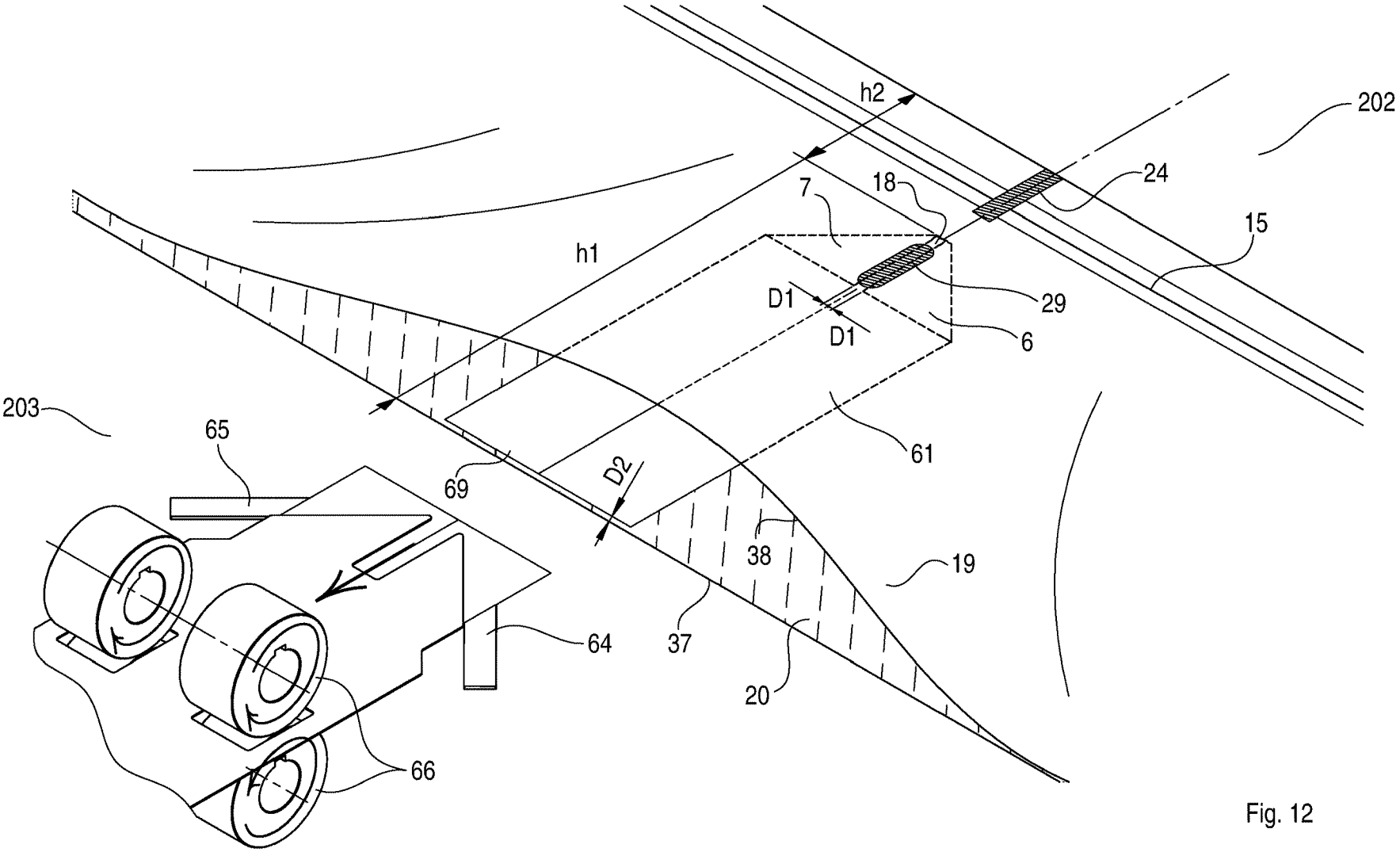
FIG. 12 shows a three-dimensional view of a successive state with respect to the one shown in FIG. 11.

After the tubular element portion 69 is secured to the front sheet and to the back sheet 19, 20 by means of welding, the tubular element 61 to which the tubular element portion 69 cut beforehand was secured, is brought back, following the direction shown by the arrow in FIG. 12. Such translation is ensured by the rotation of the rotation means 66 that rotate in the opposite direction with respect to what is described for example, in FIG. 10. It is apparent that such rotation of the rotation means 66 to cause the tubular element 61 to retract towards the folding means 64, 65 becomes necessary because the tubular element 61 was cut at the area comprised between the two sheets 19, 20. Such rotation described here is not necessary if the cutting means 33 are positioned at a given distance from the sheets 19, 20, for example upstream of the folding means 64 and 65.

Figure 13:
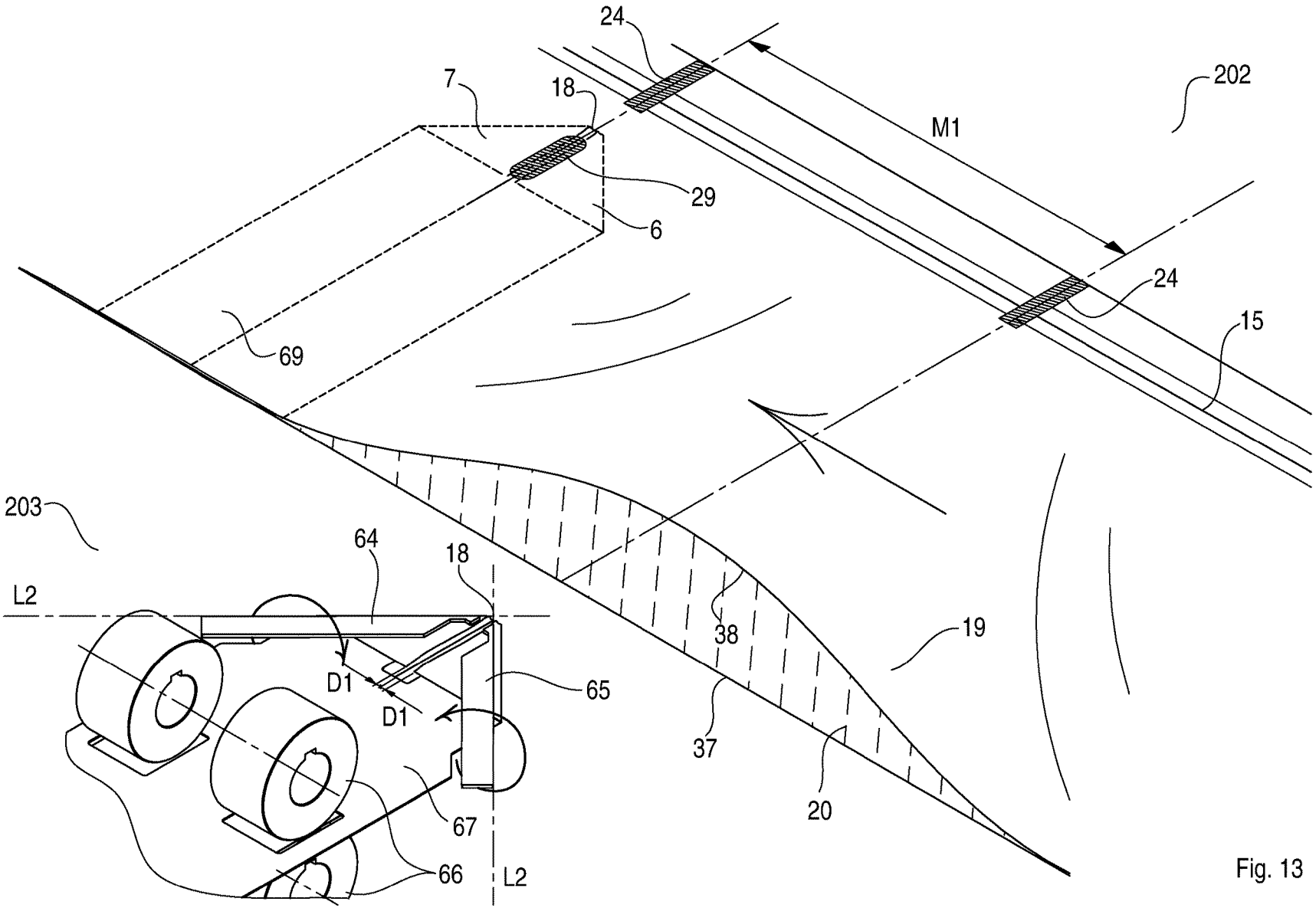
FIG. 13 shows a three-dimensional view of the detail shown in FIG. 12, in a successive state with respect to the one shown in FIG. 12.

In a successive step shown in FIG. 13, the folding means 64 and 65 make a new fold on the end portion of the tubular element 61 and in the same manner, the front and back sheets 19, 20 to which the tubular element portion 69 was sealed are caused to slide along the conveying line shown in the drawing, which allows reaching the successive stations that are described with reference to FIG. 14.

Figure 14:
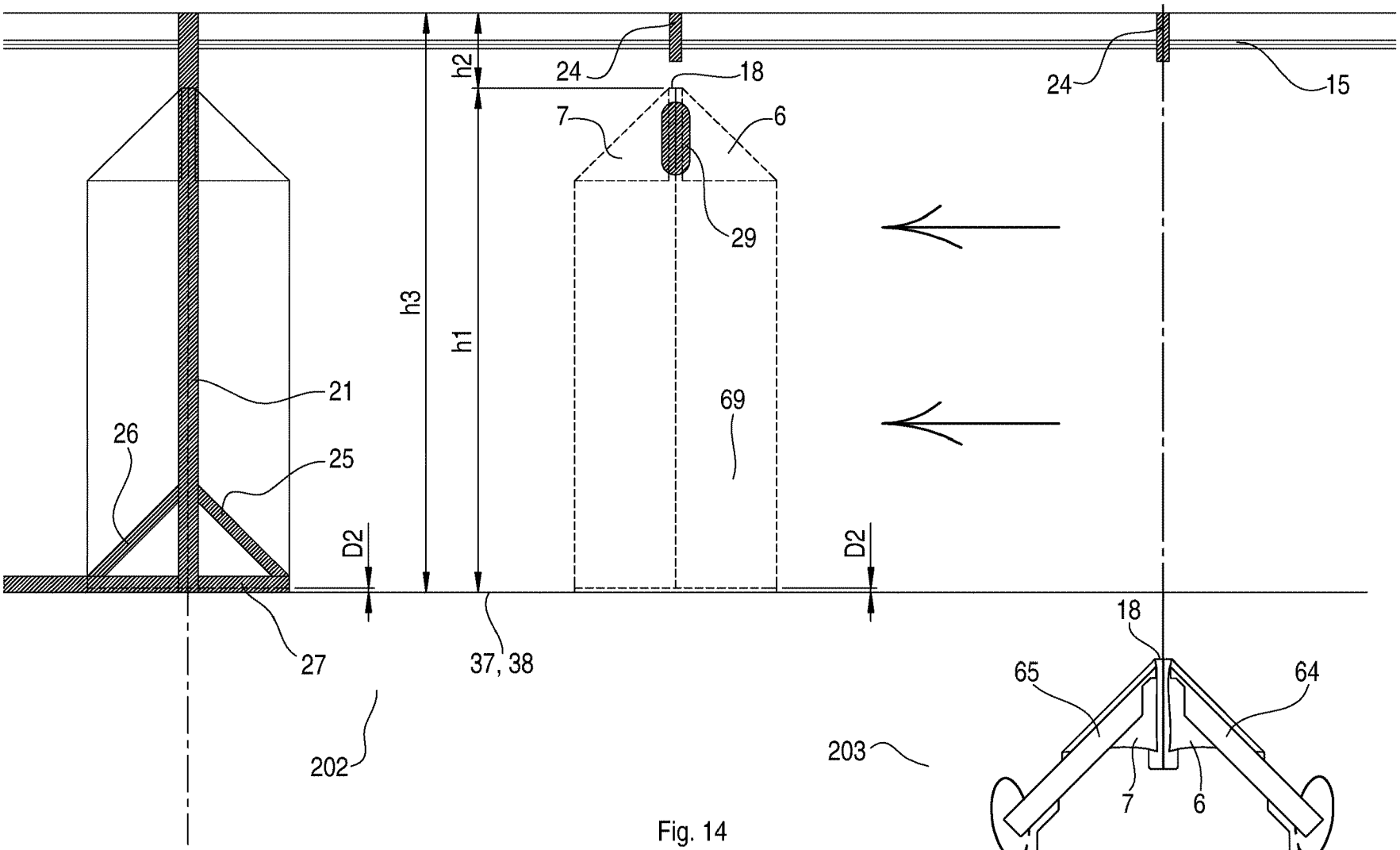
FIG. 14 shows a top view of the portion of machine shown in FIG. 13, showing the various seals made.

FIG. 14 indeed shows that the welding 21 that allows making the actual package 100 occurs in a successive section of the coupling station 202. Indeed, welding surfaces 21 are obtained perpendicular to the conveying direction, which form the side seals 22, 23 of the package 100, as described with reference to FIG. 1.

As shown, the welding surface 21 overlaps the welding surface 24 obtained by the welding grippers 43 and the welding surface 29 obtained to secure the tubular element portion 69 to the sheets 19, 20 so as to prevent the tubular element portion 69 from moving during a conveying towards the area of the machine wherein the welding surface 21 is obtained. In particular, the central axis of the welding surface 21 coincides with the central axis of the sealed surface 24.

As is apparent from the preceding description, the seal 21 has a width equal to twice the above-described distance D1, plus a predetermined quantity that will allow forming the triangular portions 6, 7 of the tubular element at the edges of the package 100.

Moreover, there are also formed the seals 27 for the lower closure of the package and the oblique seals 25 and 26 that as described above, allow preventing the content of the package to possibly remain in the corners of the package itself and to provide the package 100 with a flat bottom.

Figure 15:
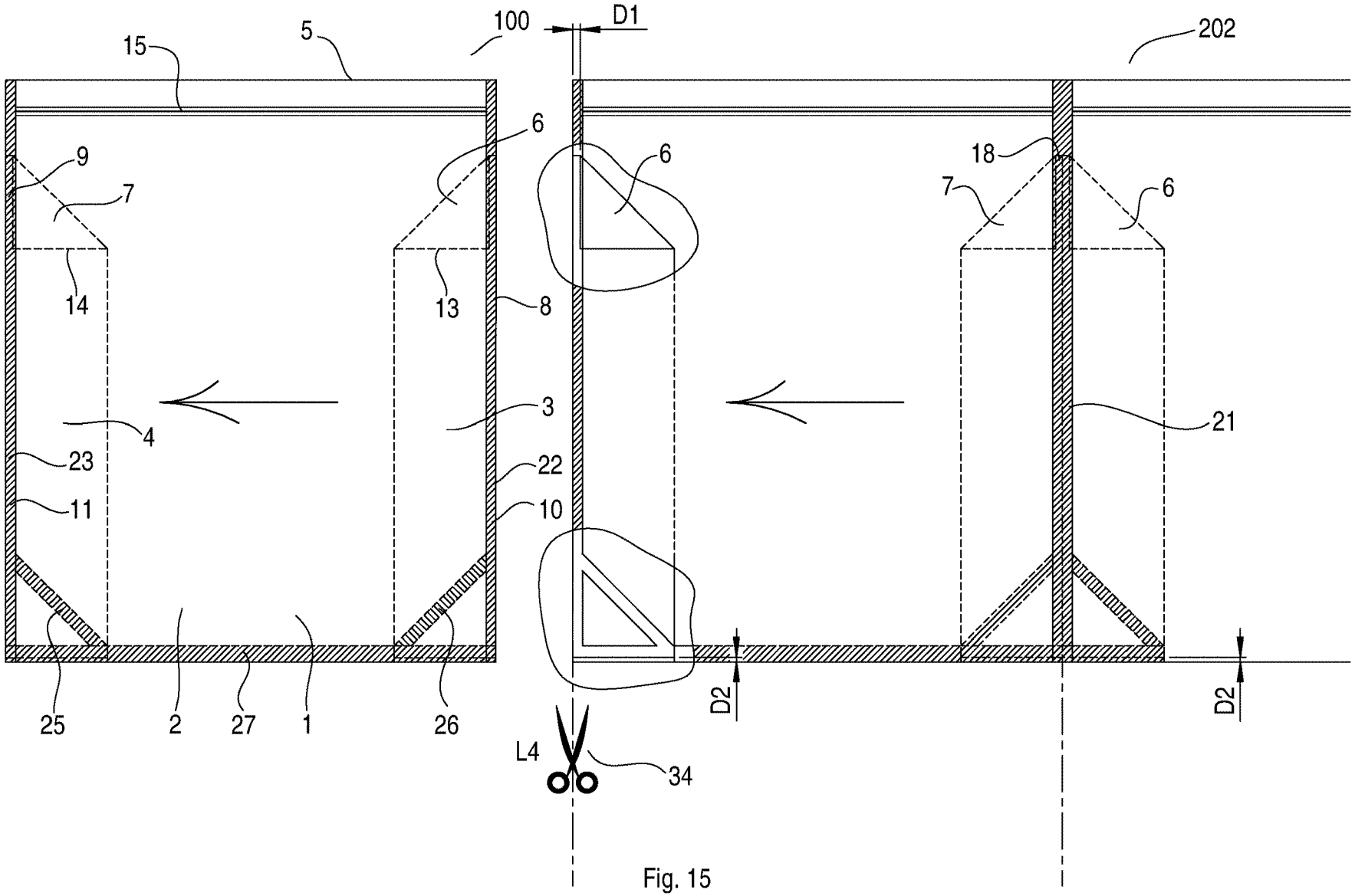
FIG. 15 shows a top view similar to the one shown in FIG. 14, which shows a successive state to the one shown in FIG. 14, that is when one package is separated from the following one.

In this manner as shown in FIG. 15, the package 100 is ready to be separated from the sheet itself so as to form a true package. Therefore, it is possible to separate the packages 100 from one another by making a cut along the cutting line L4 by means of the cutting means 34. The cutting line L4 is perpendicular to the conveying direction of the packages and divides the seal 21 into two perfectly equal parts.

Therefore, packages closed on three sides and having a reclosable opening 15 are produced downstream of the coupling station 202. The reclosable opening 15 preferably is in an open state, that is in a state wherein the first portion of the reclosable opening 15 positioned on the inner side of the front panel 1 is uncoupled from the second portion of the reclosable opening 15 positioned on the inner side of the back panel 2. In this manner, it is possible to provide packages 100 that are ready to be filled without the need to uncouple the first portion from the second portion of the reclosable opening 15, which could result in an increased waste of time.

Figure 16:
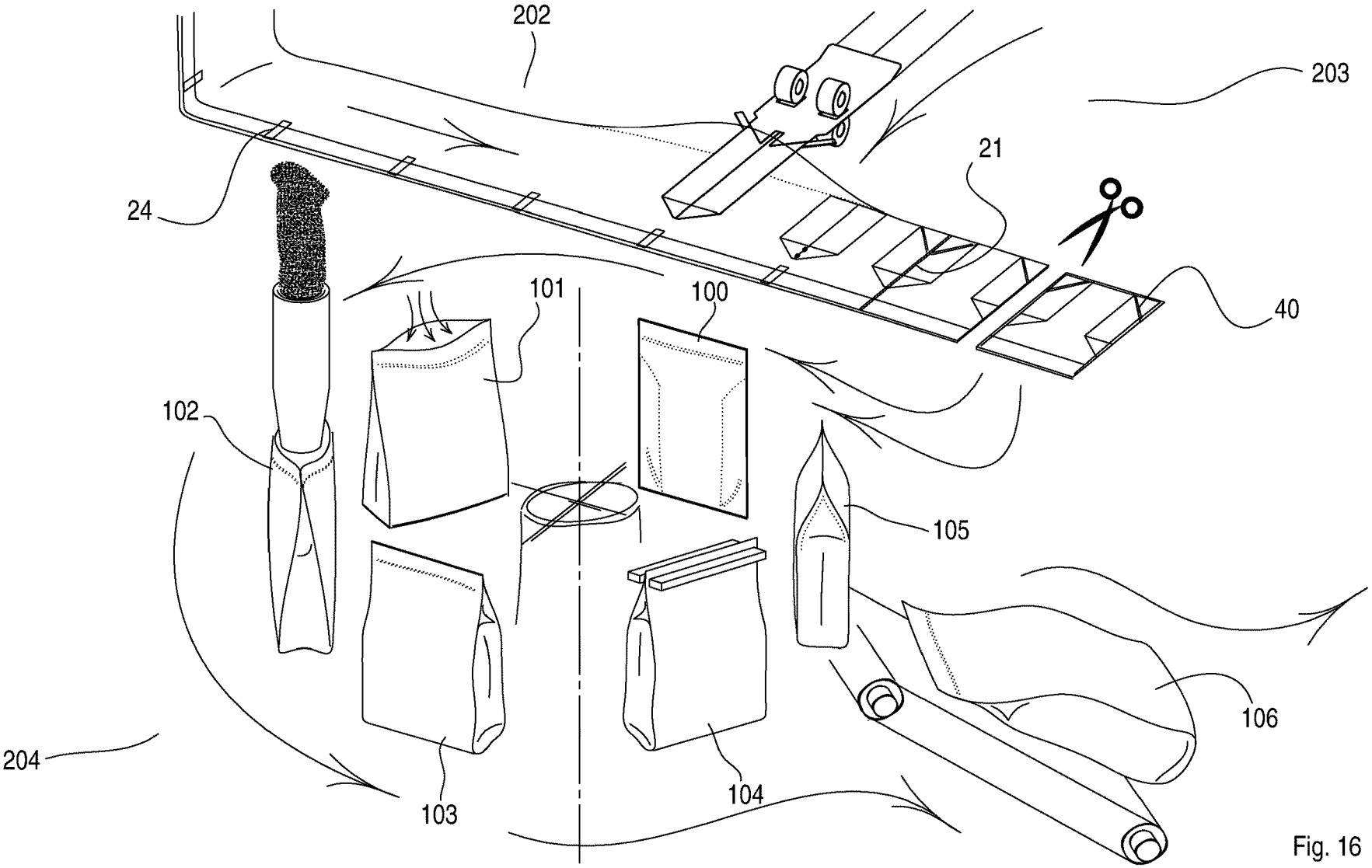
FIG. 16 shows a final state wherein the packages shown in FIG. 15 are brought into a closing station configured so as to fill the packages with product, close them and supply them to the outside.

As shown in FIG. 16, a carousel may be placed at this point that is configured so as to receive the packages 100 provided by the coupling station 202, to open them so as to insert the contents of the package through the opening 5 of the package 100.

For example as shown in the drawing, the package 100 is opened in a successive step, forming an open package 101, the open package 101 is then filled by means of a funnel, thus forming a filled package 102. The filled package 102 is then closed, forming a closed package 103 that is then sealed, thus forming the package 105 shown in the drawing that can then be provided to the outside.

It is worth noting that although the processes performed by the machine were described one following another to clarify the description, it is apparent that such processes normally are performed simultaneously so as to have a machine 200 that continuously produces packages. For example, the preparing station 201 can perform the operations described above while the tubular element forming station 203 makes the tubular element 61.

The term continuous here means a process that allows making packages one after another, thus with a temporal distance between making one package and the next. As explained by the example, the term "continuous" here therefore means that while one station performs a given process on a package, another station performs another process on another package, that is that each station preferably can work continuously.

The temporal distance between making two successive packages is due to the fact that the different steps are to be performed along the production line of the packages: from the various seals to the various folds.

Although the present invention was described with reference to the embodiments described above, it is apparent to an expert in the field that it is possible to make several modifications, variants and improvements to the present invention in light of the above teaching and within the scope of the appended claims, without departing from the object and the scope of protection of the invention.

For example, even if it has been described that the packages 100 have a reclosable opening, it is apparent that the present invention is also valid for packages that do not have a reclosable opening.

Moreover, even if it has been described in the description that the machine comprises four stations, it is possible to make a machine that contains only some of such stations. For example, the filling station 204 may be omitted in many cases wherein the production of packages and not the filling thereof, is required.

Even if it has been shown in each of the drawings that the preparing station 201 is a vertical station, it also is alternatively possible for such station to be a horizontal preparing station. Moreover, both with regards to the preparing station 201 and to the tubular element forming station 203, when reel is discussed, it means more generally any system capable of continuously providing a strip of sheet or a reclosable opening.

Finally, those fields known by experts in the field were not described to avoid excessively and uselessly overshadowing the invention described.

Accordingly, the invention is not limited to the embodiments described above, but is only limited by the scope of protection of the appended claims.

What is claimed is:

1. A method for making airtight packages made of flexible material that are configured to seal an environment inside the package with respect to an external environment, said packages comprising a front panel, a back panel and two side gussets provided at opposite ends of said front panel and of said back panel so as to connect said front panel to said back panel, comprising the following steps:

a) folding a sheet made of flexible material along two first fold lines which are mutually parallel so as to form a tubular element;

b) folding an end portion of said tubular element along two second fold lines that are oblique with respect to the direction of said first fold lines so as to form an end portion of said tubular element that has two triangular portions having two mutually parallel sides, wherein each of the mutually parallel sides is positioned at a first predetermined distance from an outer edge of the package and, in the tubular element, the mutually parallel sides have a distance between each other equal to twice the first predetermined distance;

c) conveying said tubular element having said triangular portions so as to insert said tubular element between a front sheet that will form said front panel or said back panel of said package, and a back sheet that will form said back panel or said front panel of said package; and d) cutting said tubular element along a first cutting line perpendicular to the axis of said tubular element so as to separate a portion of said tubular element.

2. A method for making sealable packages according to claim 1, wherein said first predetermined distance is greater than or equal to 1 mm.

3. A method for making sealable packages according to claim 1, wherein said method further comprises the following step:

e) securing said triangular portions to said tubular element.

4. A method for making sealable packages according to claim 1, wherein during said step d), said first cutting line along which said tubular element is cut, is positioned at a second predetermined distance with respect to an edge of said sheets at which said tubular element is inserted between said sheets; wherein said second predetermined distance is comprised between 1 and 5 mm.

5. A method for making sealable packages according to claim 1, wherein during said step c), said tubular element is conveyed up to reaching a third predetermined distance with respect to an edge of said sheets opposite to an edge at which said tubular element is inserted between said sheets; wherein said third predetermined distance is greater than or equal to 40 mm.

6. A method for making sealable packages according to claim 1, wherein said method further comprises the following step:

f) securing said tubular element portion to said front sheet and to said back sheet by means of welding performed along a welding surface parallel to the axis of said tubular element portion and positioned at said axis of said tubular element portion; said welding surface having a greater width with respect to twice said first predetermined distance, wherein said tubular element portion is secured to said front sheet and to said back sheet so that a lower edge of said tubular element portion is positioned at a second predetermined distance with respect to an edge of said sheets, at which said tubular element is inserted between said sheets so as to be spaced apart from said edge of said sheets.

7. A method for making sealable packages according to claim 6, wherein said method further comprises the following step:

g) cutting said welding surface along a second cutting line parallel to the axis of said tubular element and placed at said axis of said tubular element, said second cutting line extending for a length equal to the height of the package so as to separate one package from the next, said second cutting line being equally spaced from said mutually parallel sides of said triangular portions.

* * * * *